US012065711B2

(12) United States Patent
Yamazaki et al.

(10) Patent No.: US 12,065,711 B2
(45) Date of Patent: Aug. 20, 2024

(54) HIGH-STRENGTH HOT ROLLED STEEL SHEET AND METHOD FOR MANUFACTURING SAME

(71) Applicant: JFE Steel Corporation, Tokyo (JP)

(72) Inventors: Kazuhiko Yamazaki, Tokyo (JP); Takeshi Yokota, Tokyo (JP); Sumio Kaiho, Tokyo (JP); Noriaki Moriyasu, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 653 days.

(21) Appl. No.: 17/262,884

(22) PCT Filed: Jun. 10, 2019

(86) PCT No.: PCT/JP2019/022886
§ 371 (c)(1),
(2) Date: Jan. 25, 2021

(87) PCT Pub. No.: WO2020/026593
PCT Pub. Date: Feb. 6, 2020

(65) Prior Publication Data

US 2021/0140007 A1 May 13, 2021

(30) Foreign Application Priority Data

Jul. 31, 2018 (JP) ..... 2018-143803

(51) Int. Cl.

| | |
|---|---|
| ***C22C 38/00*** | (2006.01) |
| ***C21D 6/00*** | (2006.01) |
| ***C21D 8/00*** | (2006.01) |
| ***C21D 8/02*** | (2006.01) |
| ***C21D 9/46*** | (2006.01) |
| ***C22C 38/02*** | (2006.01) |
| ***C22C 38/06*** | (2006.01) |
| ***C22C 38/08*** | (2006.01) |
| ***C22C 38/16*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(52) U.S. Cl.

CPC ..... *C21D 9/46* (2013.01); *C21D 6/001* (2013.01); *C21D 6/002* (2013.01); *C21D 6/005* (2013.01); *C21D 6/008* (2013.01); *C21D 8/005* (2013.01); *C21D 8/0226* (2013.01); *C21D 8/0263* (2013.01); *C22C 38/001* (2013.01); *C22C 38/002* (2013.01); *C22C 38/005* (2013.01); *C22C 38/02* (2013.01); *C22C 38/06* (2013.01); *C22C 38/08* (2013.01); *C22C 38/16* (2013.01); *C22C 38/22* (2013.01); *C22C 38/26* (2013.01); *C22C 38/28* (2013.01); *C22C 38/32* (2013.01); *C22C 38/38* (2013.01); *C21D 2211/002* (2013.01); *C21D 2211/008* (2013.01)

(58) Field of Classification Search

CPC ... C22C 38/001; C22C 38/002; C22C 38/005; C22C 38/02; C22C 38/06; C22C 38/08; C22C 38/16; C22C 38/22; C22C 38/26; C22C 38/28; C22C 38/32; C22C 38/38; C21D 2211/002; C21D 2211/008

USPC ..... 428/612

See application file for complete search history.

(56) References Cited

U.S. PATENT DOCUMENTS

| | | | |
|---|---|---|---|
| 7,618,498 | B2 | 11/2009 | Kochi et al. |
| 10,400,316 | B2 | 9/2019 | Nakajima et al. |
| 2004/0231393 | A1 | 11/2004 | Mega et al. |
| 2005/0161134 | A1 | 7/2005 | Ikeda et al. |
| 2015/0376730 | A1 | 12/2015 | Shuto et al. |
| 2016/0076124 | A1 | 3/2016 | Yamazaki et al. |
| 2016/0273066 | A1 | 9/2016 | Sakakibara et al. |
| 2019/0271052 | A1 | 9/2019 | Kohsaka et al. |
| 2020/0165708 | A1 | 5/2020 | Hasegawa et al. |
| 2021/0140007 | A1 | 5/2021 | Yamazaki et al. |

FOREIGN PATENT DOCUMENTS

| | | | |
|---|---|---|---|
| CN | 101078089 | A | 11/2007 |
| CN | 105143486 | A | 12/2015 |
| EP | 1201780 | A1 | 5/2002 |
| EP | 1860205 | A1 | 11/2007 |
| EP | 2130938 | A1 | 12/2009 |

(Continued)

OTHER PUBLICATIONS

Toyoda et al., JP 2010242164 A Google Patents Machine Translation printed on Nov. 11, 2023, Oct. 28, 2010, entire translation (Year: 2010).*

Non Final Office Action for U.S. Appl. No. 16/485,978, dated Jun. 17, 2021, 10 pages.

Korean Written Decision on Registration for Korean Application No. 10-2021-7002705, dated Nov. 24, 2022 with translation, 4 pages.

Korean Office Action for Korean Application No. 10-2021-7002705, dated Jul. 14, 2022, with Concise Statement of Relevance of Office Action, 7 pages.

(Continued)

*Primary Examiner* — Katherine A Christy

(74) *Attorney, Agent, or Firm* — Buchanan Ingersoll & Rooney PC

(57) ABSTRACT

A high-strength hot rolled steel sheet and a method for manufacturing the high-strength hot rolled steel sheet are disclosed. The high-strength hot rolled steel sheet includes a specific chemical composition, and a steel structure in which a lower bainite phase and/or a tempered martensite phase at 90% or more in terms of a total area fraction is contained as a dominant phase, an average grain size of the dominant phase is 10.0 μm or less, and an amount of Fe in Fe-based precipitates is 0.70% or less in mass %, in which an arithmetic average roughness (Ra) of a surface is 2.50 μm or less, and a tensile strength TS is 1180 MPa or more.

9 Claims, No Drawings

(56) References Cited

FOREIGN PATENT DOCUMENTS

| | | | | |
|---|---|---|---|---|
| EP | 2987886 | A1 | | 2/2016 |
| EP | 2998414 | A1 | | 3/2016 |
| EP | 3282031 | A1 | | 2/2018 |
| EP | 3395974 | A1 | | 10/2018 |
| JP | 2005146379 | A | | 6/2005 |
| JP | 2006241528 | A | | 9/2006 |
| JP | 2010242164 | A | * | 10/2010 |
| JP | 2013181208 | A | | 9/2013 |
| JP | 2014227583 | A | | 12/2014 |
| JP | 5720208 | B2 | | 5/2015 |
| JP | 2015196891 | A | | 11/2015 |
| JP | 6048580 | B2 | | 12/2016 |
| JP | 2016204716 | A | | 12/2016 |
| JP | 2016211073 | A | | 12/2016 |
| JP | 2017150051 | A | | 8/2017 |
| KR | 20180085754 | A | | 7/2018 |
| WO | 2014171063 | A1 | | 10/2014 |
| WO | 2014185405 | A1 | | 11/2014 |
| WO | 2016163469 | A1 | | 10/2016 |
| WO | 2017138384 | A1 | | 8/2017 |
| WO | 2018030501 | A1 | | 2/2018 |
| WO | 2018117552 | A1 | | 6/2018 |

OTHER PUBLICATIONS

Japanese Office Action for Japanese Application No. 2019-553584, dated Aug. 6, 2020, with Concise Statement of Relevance of Office Action, 6 pages.

Extended European Search Report for European Application No. 19 843 333.6, dated Apr. 1, 2021, 12 pages.

Final Office Action for U.S. Appl. No. 16/485,978, dated Sep. 22, 2021, 10 pages.

Non Final Office Action for U.S. Appl. No. 16/485,978, dated Jun. 2, 2022, 13 pages.

Final Office Action for U.S. Appl. No. 16/485,978, dated Sep. 8, 2022, 10 pages.

International Search Report and Written Opinion for International Application No. PCT/JP2019/022886, dated Sep. 10, 2019. 7 pages.

Chinese Office Action with Search Report for Chinese Application No. 201980050754.9, dated Oct. 8, 2021, 11 pages.

* cited by examiner

HIGH-STRENGTH HOT ROLLED STEEL SHEET AND METHOD FOR MANUFACTURING SAME

CROSS REFERENCE TO RELATED APPLICATIONS

This is the U.S. National Phase application of PCT/JP2019/022886, filed Jun. 10, 2019, which claims priority to Japanese Patent Application No. 2018-143803, filed Jul. 31, 2018, the disclosures of these applications being incorporated herein by reference in their entireties for all purposes.

FIELD OF THE INVENTION

The present invention relates to a high-strength hot rolled steel sheet that has a tensile strength TS of 1180 MPa or more and is excellent in press formability and low-temperature toughness and that is suitable as a structural member, a framework member, or an automotive chassis such as a suspension of an automobile, a truck frame member, or a member for construction equipment, and a method for manufacturing the same.

BACKGROUND OF THE INVENTION

These days, automotive emission control is reinforced from the viewpoint of the conservation of the global environment. Hence, an improvement in automotive fuel efficiency is an important issue. Then, further strength increase and sheet metal thinning are required. In association with this, a high-strength hot rolled steel sheet is becoming actively used as a material of automotive parts. The high-strength hot rolled steel sheet is used not only for automotive structural members and framework members but also for automotive chassis, truck frame members, members for construction equipment, and the like.

As described above, a high-strength hot rolled steel sheet having a predetermined strength is growing in demand year by year as a material of automotive parts. In particular, a high-strength hot rolled steel sheet having a tensile strength TS of 1180 MPa or more is greatly expected as a material capable of drastically improving automotive fuel efficiency.

However, material properties such as stretch flange formability, bendability, and low-temperature toughness are generally degraded in association with the strength increase of the steel sheet. An automotive chassis is formed mainly by press forming, and the material is required to have excellent stretch flange formability and bendability.

Further, an automotive member is required to, after installed in an automobile as a member after press forming, be less likely to be fractured even when it receives an impact due to a collision or the like. Also low-temperature toughness needs to be improved in order to ensure impact resistance particularly in a cold district.

The stretch flange formability is measured by a hole expansion test conforming to a standard of The Japan Iron and Steel Federation, JFS T 1001, or the like. The bendability is measured by a bending test conforming to JIS Z 2248, or the like. The low-temperature toughness is measured by a Charpy impact test conforming to JIS Z 2242, or the like.

As above, various studies have so far been conducted in order to achieve a strength increase of a steel sheet without degrading the material properties mentioned above.

For example, Patent Literature 1 discloses a high-strength hot rolled steel sheet that is excellent in elongation, hole expansion formability, and secondary processing crack resistance and that has a steel structure in which the tempered martensite fraction is 5% or more, the balance includes ferrite and bainite, the retained austenite fraction is 2% or less, and martensite accounts for less than 1%, and a method for manufacturing the same that includes performing rolling at a rolling delivery temperature of the Ar3 transformation point or more, performing coiling at 200° C. or less, and then performing reheating again under the condition shown in the following formula.

$$12000 \leq (T+273) \times (\log(t/60)+19.8) \leq 17000$$

T: the heat treatment temperature (° C.), t: the treatment time (min)

In addition, Patent Literature 2 discloses a high-strength hot rolled steel sheet excellent in stretch flange formability that has a chemical composition containing, in mass %, C: 0.01% or more and 0.35% or less, Si: 2.0% or less, Mn: 0.1% or more and 4.0% or less, Al: 0.001% or more and 2.0% or less, P: 0.2% or less, S: 0.0005% or more and 0.02% or less, N: 0.02% or less, and O: 0.0003% or more and 0.01% or less and has a steel structure in which the tempered martensite fraction is 5% or more, the retained austenite fraction is less than 2%, the martensite fraction is less than 1%, and the pearlite fraction is less than 5% in terms of phase fraction and the balance includes ferrite and bainite, and in which the average grain size of the tempered martensite phase mentioned above is in the range of 0.5 μm or more and 5 μm or less.

Patent Literature 3 discloses a high-strength hot rolled steel sheet that has a chemical composition of, in mass %, C: 0.05% or more and 0.20% or less, Si: 0.01% or more and 0.55% or less, Mn: 0.1% or more and 2.5% or less, P: 0.1% or less, S: 0.01% or less, Al: 0.005% or more and 0.10% or less, N: 0.01% or less, Nb: 0.005% or more and 0.10% or less, and B: 0.0003% or more and 0.0050% or less and has a structure in which martensite accounts for 90% or more of the structure and the average aspect ratio of prior austenite grains in the vicinity of an surface layer is 3 or more and 20 or less. It is disclosed that a steel sheet excellent in bendability can be manufactured by, after rough rolling, performing finish rolling at a cumulative rolling reduction ratio in an unrecrystallized austenite region of more than 40% and 80% or less, ending the finish rolling at the Ar3 point or more, performing cooling at an average cooling rate of 15° C./s or more, and performing coiling in the temperature region of 200° C. or less.

In Patent Literature 4, a steel material of a composition containing, in mass %, C: 0.08% or more and less than 0.16%, Si: 0.01 to 1.0%, Mn: 0.8 to 2.0%, Al: 0.005 to 0.10%, and N: 0.002 to 0.006% and further containing Nb, Ti, Cr, and B is heated to a temperature of 1100 to 1250° C., is subjected to rough rolling at an RDT of 900 to 1100° C. and finish rolling at an FET of 900 to 1100° C. and an FDT of 800 to 900° C. and at a cumulative rolling reduction ratio in the temperature region of less than 930° C. of 20 to 90%, is, after the end of the finish rolling, cooled down to a cooling stop temperature of 300° C. or less at an average cooling rate of 100° C./s or more, and is coiled at a temperature of 300° C. or less. It is disclosed that, thereby, a high-strength hot rolled steel sheet excellent in bendability and low-temperature toughness in which a martensite phase and/or a tempered martensite phase at 90 area% or more is contained as a dominant phase, the average grain size of prior y grains is 20 μm or less in an L-cross section, the aspect ratio is 18 or less, and the YS is 960 MPa or more is obtained.

Patent Literature 5 discloses a high-strength hot rolled steel sheet that has a maximum tensile strength of 980 MPa or more and is excellent in stretch flange formability and low-temperature toughness and in which the chemical composition contains, in mass %, C: 0.01 to 0.20%, Si: 2.50% or less (not including 0), Mn: 4.00% or less (not including 0), P: 0.10% or less (not including 0), S: 0.03% or less (not including 0), Al: 0.001 to 2.00%, N: 0.01% or less (not including 0), O: 0.01% or less (not including 0), one or two of Ti and Nb: 0.01 to 0.30% in total, and the balance including iron and incidental impurities, the microstructure contains one or both of tempered martensite and lower bainite at 90% or more in total in terms of volume fraction, and the standard deviation σ of Vickers hardness distribution is 15 or less.

Patent Literature 6 discloses a hot rolled steel sheet that has a chemical composition containing, in mass %, C: 0.01 to 0.2%, Si: 2.50% or less (not including 0), Mn: 1.0 to 4.00%, P: 0.10% or less, S: 0.03% or less, Al: 0.001 to 2.0%, N: 0.01% or less (not including 0), O: 0.01% or less (not including 0), Cu: 0 to 2.0%, Ni: 0 to 2.0%, Mo: 0 to 1.0%, V: 0 to 0.3%, Cr: 0 to 2.0%, Mg: 0 to 0.01%, Ca: 0 to 0.01%, REMs: 0 to 0.1%, B: 0 to 0.01%, one or both of Ti and Nb: 0.01 to 0.30% in total, and the balance including iron and impurities and has a structure in which the volume fraction of tempered martensite and lower bainite is 90% or more in total, and in which the average effective crystal grain size of a portion extending ¼ from a surface is 10 μm or less, the average effective crystal grain size of a portion extending 50 μm from the surface is 6 μm or less, the number of pieces of iron-based carbides existing in the tempered martensite and the lower bainite is $1\times10^6$ (/mm$^2$) or more, and the average aspect ratio of effective crystal grains of the tempered martensite and the lower bainite is 2 or less.

PATENT LITERATURE

Patent Literature 1: JP 2005-146379 A
Patent Literature 2: JP 2013-181208 A
Patent Literature 3: JP 2014-227583 A
Patent Literature 4: JP 2016-211073 A
Patent Literature 5: JP 2015-196891 A
Patent Literature 6: JP 6048580 B2

SUMMARY OF THE INVENTION

However, the technologies described in Patent Literatures 1 and 2 need the process of reheating a hot rolled steel sheet in order to obtain excellent stretch flange formability, and have had a problem that a high strength of 1180 MPa or more is not obtained.

In the technology described in Patent Literature 3, although there is a mention of bendability with a high strength of 1180 MPa or more, there is no mention of stretch flange formability or low-temperature toughness; and it is feared that a brittle fracture will be caused in the case of being used in a cold district.

In the technology described in Patent Literature 4, although there is a mention of bendability and low-temperature toughness with a high strength of 1180 MPa or more, there is no mention of stretch flange formability; and it is feared that forming failure will be caused in use for a member that is required to have high stretch flange formability, like an automotive chassis.

In the technology described in Patent Literature 5, although there is a mention of stretch flange formability and low-temperature toughness, there is no mention of bendability; it is feared that forming failure will be caused in the case of being used for a member that is required to have high bendability, such as a truck frame member or a construction equipment member; and there has been a problem that a high strength of 1180 MPa or more is not obtained.

In the technology described in Patent Literature 6, although there is a mention of low-temperature toughness, there is no mention of stretch flange formability or bendability; and it is feared that forming failure will be caused in the case of being used for a member that is required to have high stretch flange formability, such as an automotive chassis, or a member that is required to have high bendability, such as a truck frame member or a construction equipment member.

As above, in conventional technologies, a technology of a hot rolled steel sheet that has excellent stretch flange formability, bendability, and low-temperature toughness while maintaining high strength of a tensile strength TS of 1180 MPa or more is not established.

Thus, an object according to aspects of the present invention is to provide a high-strength hot rolled steel sheet that solves problems of such conventional technologies and that has excellent stretch flange formability, bendability, and low-temperature toughness while maintaining high strength of a tensile strength TS of 1180 MPa or more, and a method for manufacturing the same.

In order to solve the issue mentioned above, the present inventors conducted extensive studies so as to improve the stretch flange formability, bendability, and low-temperature toughness of a hot rolled steel sheet while maintaining high strength of a tensile strength TS of 1180 MPa or more. As a result, it has been found that a high strength of 1180 MPa or more and excellent low-temperature toughness are obtained by setting the steel structure to contain a lower bainite phase and/or a tempered martensite phase as a dominant phase and controlling the area average grain size (the average grain size) of the steel structure, excellent stretch flange formability is obtained by controlling the amount of Fe in Fe-based precipitates, and high bendability is obtained by controlling the arithmetic average roughness (Ra) of a surface of the hot rolled steel sheet.

The lower bainite phase and/or the tempered martensite phase herein means a structure containing Fe-based carbides in the lath and/or between laths of lath-like ferrite. The orientation and the crystal structures of Fe-based carbides in the lath can be distinguished between lower bainite and tempered martensite by using a TEM (transmission electron microscope); however, in accordance with aspects of the present invention, lower bainite and tempered martensite have substantially the same properties, and are therefore not distinguished. Unlike lamellar (layer-like) ferrite in a pearlite phase or polygonal ferrite, lath-like ferrite has a lath-like shape and has a relatively high dislocation density in its interior; therefore, both can be distinguished by using a SEM (scanning electron microscope) or a TEM. An upper bainite phase means a structure having a retained austenite phase between laths of lath-like ferrite. A pearlite phase means a structure containing lamellar ferrite and Fe-based carbides. Lamellar ferrite has a lower dislocation density than lath-like ferrite; therefore, the pearlite phase, and the lower bainite phase and/or the tempered martensite phase or the upper bainite phase can be easily distinguished with a SEM, a TEM, or the like. A fresh martensite phase, an martensite-austenite constituent phase (a martensite-retained austenite mixed phase), and a massive retained austenite phase are structures not containing Fe-based carbides as compared to the tempered martensite phase, and can be distinguished from the tempered martensite phase by using a SEM. The fresh martensite phase, the martensite-austenite constituent phase (a martensite-retained austenite mixed phase), and the massive retained austenite phase have similar massive shapes and similar contrasts in a SEM; thus, an electron backscatter diffraction patterns (EBSD) method may be used to distinguish them. The retained austenite phase in the upper bainite phase has a lath-like shape, and is different in shape from the massive retained austenite phase; thus, both retained austenite phases can be easily distinguished. A polygonal ferrite phase is generated at a higher temperature than the upper bainite phase and is massive, and can therefore be easily distinguished from lath-like ferrite with a SEM, a TEM, or the like.

Based on the above findings, the present inventors conducted further research, and studied the chemical composition, the area fraction and the average grain size of the lower bainite phase and/or the tempered martensite phase, the amount of Fe of Fe-based precipitates, and the arithmetic average roughness (Ra) of a surface of a hot rolled steel sheet necessary to improve stretch flange formability, bendability, and low-temperature toughness in a state where high strength of a tensile strength TS of 1180 MPa or more is maintained.

In addition, we found that it is important to include: a chemical composition containing, in mass %, C: 0.07% or more and 0.20% or less, Si: 0.10% or more and 2.0% or less, Mn: 0.8% or more and 3.0% or less, P: 0.100% or less (including 0%), S: 0.0100% or less (including 0%), Al: 0.010% or more and 2.00% or less, N: 0.010% or less (including 0%), Ti: 0.02% or more and less than 0.16%, B: 0.0003% or more and 0.0100% or less, and the balance including Fe and incidental impurities; and in a steel structure, a lower bainite phase and/or a tempered martensite phase at 90% or more in terms of area fraction is contained as a dominant phase, an average grain size of the dominant phase is 10.0 μm or less, and an amount of Fe in Fe-based precipitates is 0.70% or less in mass %, and an arithmetic average roughness (Ra) of a surface of the steel sheet is 2.50 μm or less.

Aspects of the present invention are completed by adding further studies on the basis of such findings, and are as follows.

[1] A high-strength hot rolled steel sheet includes: a chemical composition containing, in mass %, C: 0.07% or more and 0.20% or less, Si: 0.10% or more and 2.0% or less, Mn: 0.8% or more and 3.0% or less, P: 0.100% or less (including 0%), S: 0.0100% or less (including 0%), Al: 0.010% or more and 2.00% or less, N: 0.010% or less (including 0%), Ti: 0.02% or more and less than 0.16%, B: 0.0003% or more and 0.0100% or less, and the balance including Fe and incidental impurities; and a steel structure in which a lower bainite phase and/or a tempered martensite phase at 90% or more in terms of a total area fraction is contained as a dominant phase, an average grain size of the dominant phase is 10.0 μm or less, and an amount of Fe in Fe-based precipitates is 0.70% or less in mass %, in which an arithmetic average roughness (Ra) of a surface is 2.50 μm or less, and a tensile strength TS is 1180 MPa or more.

[2] The high-strength hot rolled steel sheet according to [1], in which the chemical composition further contains one or two or more selected from, in mass %, Cr: 0.01% or more and 2.0% or less, Mo: 0.01% or more and 0.50% or less, Cu: 0.01% or more and 0.50% or less, and Ni: 0.01% or more and 0.50% or less.

[3] The high-strength hot rolled steel sheet according to [1] or [2], in which the chemical composition further contains one or two selected from, in mass %, Nb: 0.001% or more and 0.060% or less, and V: 0.01% or more and 0.50% or less.

[4] The high-strength hot rolled steel sheet according to any one of [1] to [3], in which the chemical composition further contains, in mass %, Sb: 0.0005% or more and 0.0500% or less.

[5] The high-strength hot rolled steel sheet according to any one of [1] to [4], in which the chemical composition further contains one or two or more selected from, in mass %, Ca: 0.0005% or more and 0.0100% or less, Mg: 0.0005% or more and 0.0100% or less, and REMs: 0.0005% or more and 0.0100% or less.

[6] The high-strength hot rolled steel sheet according to any one of [1] to [5], including: a coating layer on a surface.

[7] A method for manufacturing the high-strength hot rolled steel sheet according to any one of [1] to [5], the method including: heating a steel material to 1150° C. or more; performing rough rolling on the steel material after the heating; performing, before finish rolling to be performed after the rough rolling, high-pressure water descaling under a condition of a collision pressure of 2.5 MPa or more; performing finish rolling on a steel sheet after the high-pressure water descaling under a condition of a finisher delivery temperature of (RC−200° C.) or more and (RC+50° C.) or less, where the RC temperature is defined by Formula (1); starting cooling after an end of the finish rolling, and performing cooling under conditions of a cooling stop temperature of 200° C. or more and an Ms temperature or less, where the Ms temperature is defined by Formula (2), and an average cooling rate of 20° C./s or more, and under a condition of a time from the end of the finish rolling to a start of the cooling being within 2.0 s in a case where the finisher delivery temperature is RC or more; coiling the steel sheet after the cooling at the cooling stop temperature; and cooling the steel sheet under conditions of an average cooling rate of less than 20° C./s and a cooling stop temperature of 100° C. or less after the coiling, $$RC\ (^\circ\ \text{C.})=850+100\times C+100\times N+10\times Mn+700\times Ti+5000\times B+10\times Cr+50\times Mo+2000\times Nb+150\times V \quad \text{Formula (1)}$$

$$Ms\ (^\circ\ \text{C.})=560-470\times C-33\times Mn-24\times Cr-17\times Ni-20\times Mo \quad \text{Formula (2)}$$

where each of symbols of elements in Formula (1) and Formula (2) is a content amount (mass %) in steel of a respective element, and a symbol of an element in the formulae of a not-contained element is set to 0 for calculation.

[8] The method for manufacturing a high-strength hot rolled steel sheet according to [7], further including: performing coating treatment on a surface of a steel sheet.

According to aspects of the present invention, a high-strength hot rolled steel sheet that has a tensile strength TS of 1180 MPa or more and is excellent in stretch flange formability, bendability, and low-temperature toughness is obtained.

Further, according to the manufacturing method according to aspects of the present invention, the high-strength hot rolled steel sheet according to aspects of the present invention mentioned above can be stably manufactured.

In the case where the high-strength hot rolled steel sheet according to aspects of the present invention is used for automotive chassis, structural members, framework members, truck frame members, construction equipment members, or the like, the weight of the automotive body is lessened while the safety of the automobile is ensured; thus, a contribution can be made to a reduction in environmental load, and a marked effect in terms of industry is exhibited.

DETAILED DESCRIPTION OF EMBODIMENTS OF THE INVENTION

Hereinbelow, embodiments of the present invention are specifically described. Here, the present invention is not limited to the embodiments described below.

A high-strength hot rolled steel sheet according to aspects of the present invention includes a chemical composition containing, in mass %, C: 0.07% or more and 0.20% or less, Si: 0.10% or more and 2.0% or less, Mn: 0.8% or more and 3.0% or less, P: 0.100% or less (including 0%), S: 0.0100% or less (including 0%), Al: 0.010% or more and 2.00% or less, N: 0.010% or less (including 0%), Ti: 0.02% or more and less than 0.16%, B: 0.0003% or more and 0.0100% or less, and the balance including Fe and incidental impurities.

First, the reasons for limiting the chemical composition of the high-strength hot rolled steel sheet according to aspects of the present invention are described. The "%" below indicating the chemical composition means mass % unless otherwise specified.

C: 0.07% or more and 0.20% or less

C is an element that improves the strength of the steel and improves hardenability to promote the generation of the lower bainite phase and/or the tempered martensite phase. In accordance with aspects of the present invention, in order to achieve a high strength of 1180 MPa or more, the content amount of C needs to be set to 0.07% or more. On the other hand, if the content amount of C is more than 0.20%, the generation of Fe-based carbides is increased, and the amount of Fe in Fe-based precipitates cannot be controlled to 0.70% or less in mass %. Thus, the content amount of C is set to 0.07% or more and 0.20% or less. Preferably, the content amount of C is 0.08% or more and 0.19% or less. More preferably, the content amount of C is 0.08% or more and 0.17% or less. Still more preferably, the content amount of C is 0.09% or more and less than 0.15%.

Si: 0.10% or more and 2.0% or less

Si is an element that contributes to solid solution strengthening, and is an element that contributes to an improvement in the strength of the steel. Further, Si has the effect of suppressing the formation of Fe-based carbides, and is one of the elements necessary to control the amount of Fe in Fe-based precipitates and improve bendability. To obtain such effects, the content amount of Si needs to be set to 0.10% or more. On the other hand, Si is an element that forms subscales on the surface of the steel sheet during hot rolling. If the content amount of Si is more than 2.0%, subscales become too thick, the arithmetic average roughness (Ra) of the surface of the steel sheet after descaling becomes excessive, and the bendability of the hot rolled steel sheet is degraded. Thus, the content amount of Si is set to 2.0% or less. Preferably, the content amount of Si is 0.20% or more and 1.8% or less. More preferably, the content amount of Si is 0.40% or more and 1.7% or less. Still more preferably, the content amount of Si is 0.50% or more and 1.5% or less.

Mn: 0.8% or more and 3.0% or less

Mn contributes to an increase in the strength of the steel by solid solution, and promotes the generation of the lower bainite phase and/or the tempered martensite phase by an improvement in hardenability. To obtain such effects, the content amount of Mn needs to be set to 0.8% or more. On the other hand, if the content amount of Mn is more than 3.0%, the amount of the fresh martensite phase is increased, and the low-temperature toughness of the hot rolled steel sheet is degraded. Thus, the content amount of Mn is set to 0.8% or more and 3.0% or less. Preferably, the content amount of Mn is 1.0% or more and 2.8% or less. More preferably, the content amount of Mn is 1.2% or more and 2.6% or less. Still more preferably, the content amount of Mn is 1.4% or more and 2.4% or less.

P: 0.100% or less (including 0%)

P is an element that contributes to an increase in the strength of the steel by solid solution. However, P is also an element that segregates at austenite grain boundaries at the time of hot rolling and consequently causes a crack at the time of hot rolling. Further, even if the occurrence of a crack is avoided successfully, P segregates at grain boundaries and reduces low-temperature toughness, and reduces processability. Hence, the content amount of P is preferably set as low as possible; however, containing of P up to 0.100% can be acceptable. Thus, the content amount of P is set to 0.100% or less. Preferably, the content amount of P is 0.050% or less, and more preferably, the content amount of P is 0.020% or less.

S: 0.0100% or less (including 0%)

S binds to Ti or Mn and forms coarse sulfides, and reduces the low-temperature toughness of the hot rolled steel sheet. Hence, the content amount of S is preferably set as low as possible; however, containing of S up to 0.0100% can be acceptable. Thus, the content amount of S is set to 0.0100% or less. From the viewpoint of low-temperature toughness, the content amount of S is preferably set to 0.0050% or less, and more preferably, the content amount of S is 0.0030% or less.

Al: 0.010% or more and 2.00% or less

Al acts as a deoxidizer, and is an element effective to improve the cleanliness of the steel. If Al accounts for less than 0.010%, the effect of Al is not always sufficient; thus, the content amount of Al is set to 0.010% or more. Further, similarly to Si, Al has an effect of suppressing the formation of carbides, and is one of the elements necessary to control the amount of Fe in Fe-based precipitates and improve stretch flange formability. On the other hand, excessive addition of Al causes an increase in the amount of oxide inclusions, reduces the toughness of the hot rolled steel sheet, and is a cause of the occurrence of a flaw. Thus, the content amount of Al is set to 0.010% or more and 2.00% or less. Preferably, the content amount of Al is 0.015% or more and 1.80% or less. More preferably, the content amount of Al is 0.020% or more and 1.50% or less.

N: 0.010% or less (including 0%)

N binds to nitride-forming elements and consequently precipitates as nitrides, and contributes to making the crystal grain finer. However, N is likely to bind to Ti at high temperature and become coarse nitrides, and reduces the toughness of the hot rolled steel sheet. Thus, the content amount of N is set to 0.010% or less. Preferably, the content amount of N is 0.008% or less. More preferably, the content amount of N is 0.006% or less.

Ti: 0.02% or more and less than 0.16%

Ti is an element having an action of improving the strength of the steel sheet by precipitation strengthening or solid solution strengthening. Ti forms nitrides in an austenite phase high temperature region (a region at high temperature in the austenite phase and a region at a higher temperature than the temperature of the austenite phase (in the stage of casting)). Thereby, the precipitation of BN is suppressed, and B enters a solid solution state; thus, hardenability necessary to generate the lower bainite phase and/or the tempered martensite phase can be obtained, and a contribution is made to an improvement in strength. Further, Ti raises the recrystallization temperature of the austenite phase at the time of hot rolling, and thereby enables rolling in an austenite un-recrystallized region; thus, contributes to a grain size reduction of the lower bainite phase and/or the tempered martensite phase, and improves low-temperature toughness. To bring out these effects, the content amount of Ti needs to be set to 0.02% or more. On the other hand, if the content amount of Ti is 0.16% or more, the generation of martensite-austenite constituent is promoted, and stretch flange formability and low-temperature toughness are degraded. Thus, the content amount of Ti is set to 0.02% or more and less than 0.16%. Preferably, the content amount of Ti is 0.02% or more and 0.15% or less. More preferably, the content amount of Ti is 0.03% or more and 0.14% or less. Still more preferably, the content amount of Ti is 0.04% or more and 0.13% or less.

B: 0.0003% or more and 0.0100% or less

B is an element that segregates at prior austenite grain boundaries and suppresses the generation of ferrite, and thereby promotes the generation of the lower bainite phase and/or the tempered martensite phase and contributes to an improvement in strength and an improvement in stretch flange formability of the steel sheet. To bring out these effects, the content amount of B is set to 0.0003% or more. On the other hand, if the content amount of B is more than 0.0100%, the effects mentioned above are saturated. Thus, the content amount of B is limited within the range of 0.0003% or more and 0.0100% or less. Preferably, the content amount of B is 0.0006% or more and 0.0050% or less, and more preferably, the content amount of B is in the range of 0.0007% or more and 0.0030% or less.

The steel sheet according to aspects of the present invention can obtain the target properties by using the above essential contained elements; however, the high-strength hot rolled steel sheet according to aspects of the present invention may, as necessary, contain the arbitrary elements mentioned below for the purpose of, for example, further increase of strength or further improvement in stretch flange formability, bendability, or low-temperature toughness.

One or two or more selected from Cr: 0.01% or more and 2.0% or less, Mo: 0.01% or more and 0.50% or less, Cu: 0.01% or more and 0.50% or less, Ni: 0.01% or more and 0.50% or less Cr: 0.01% or more and 2.0% or less Cr is an element having an action of improving the strength of the steel sheet by solid solution strengthening. Further, Cr is an element that promotes the generation of the lower bainite phase and/or the tempered martensite phase by an improvement in hardenability. Further, Cr has an effect of suppressing the formation of Fe-based carbides, and is one of the elements necessary to control the amount of Fe in Fe-based precipitates and improve stretch flange formability. To bring out these effects, the content amount of Cr is set to 0.01% or more. On the other hand, similarly to Si, Cr is an element that forms subscales on the surface of the steel sheet during hot rolling. Hence, if the content amount of Cr is more than 2.0%, subscales become too thick, the arithmetic average roughness (Ra) of the surface of the steel sheet after descaling becomes excessive, and the bendability of the hot rolled steel sheet is degraded. Thus, in the case where Cr is contained, the content amount of Cr is set to 0.01% or more and 2.0% or less. Preferably, the content amount of Cr is 0.05% or more and 1.8% or less. More preferably, the content amount of Cr is 0.10% or more and 1.5% or less. Still more preferably, the content amount of Cr is 0.15% or more and 1.0% or less.

Mo: 0.01% or more and 0.50% or less Mo contributes to an increase in the strength of the steel by solid solution, and promotes the generation of the lower bainite phase and/or the tempered martensite phase by an improvement in hardenability. To obtain such effects, the content amount of Mo needs to be set to 0.01% or more. On the other hand, if the content amount of Mo is more than 0.50%, the amount of the fresh martensite phase is increased, and the low-temperature toughness of the hot rolled steel sheet is degraded. Thus, in the case where Mo is contained, the content amount of Mo is set to 0.01% or more and 0.50% or less. Preferably, the content amount of Mo is 0.05% or more and 0.40% or less. More preferably, the content amount of Mo is 0.10% or more and 0.30% or less.

Cu: 0.01% or more and 0.50% or less

Cu contributes to an increase in the strength of the steel by solid solution. Further, Cu promotes the formation of the lower bainite phase and/or the tempered martensite phase through an improvement in hardenability, and contributes to an improvement in strength. To obtain these effects, the content amount of Cu is preferably set to 0.01% or more; however, if the content amount of Cu is more than 0.50%, a reduction in the surface properties of the hot rolled steel sheet is caused, and the bendability of the hot rolled steel sheet is degraded. Thus, in the case where Cu is contained, the content amount of Cu is set to 0.01% or more and 0.50% or less. Preferably, the content amount of Cu is 0.05% or more and 0.30% or less.

Ni: 0.01% or more and 0.50% or less

Ni contributes to an increase in the strength of the steel by solid solution. Further, Ni promotes the formation of the lower bainite phase and/or the tempered martensite phase through an improvement in hardenability, and contributes to an improvement in strength. To obtain these effects, the content amount of Ni is preferably set to 0.01% or more. However, if the content amount of Ni is more than 0.50%, the amount of the fresh martensite phase is increased, and the low-temperature toughness of the hot rolled steel sheet is degraded. Thus, in the case where Ni is contained, the content amount of Ni is set to 0.01% or more and 0.50% or less. Preferably, the content amount of Ni is 0.05% or more and 0.30% or less.

One or two selected from Nb: 0.001% or more and 0.060% or less and V: 0.01% or more and 0.50% or less Nb: 0.001% or more and 0.060% or less Nb is an element having an action of improving the strength of the steel sheet by precipitation strengthening or solid solution strengthening. Further, same as Ti, Nb raises the recrystallization temperature of the austenite phase at the time of hot rolling, and enables rolling in an austenite un-recrystallized region; thus, contributes to a grain size reduction of the lower bainite phase and/or the tempered martensite phase, and improves low-temperature toughness. To bring out these effects, the content amount of Nb needs to be set to 0.001% or more. On the other hand, if the content amount of Nb is more than 0.060%, the generation of martensite-austenite constituent is promoted, and stretch flange formability and low-temperature toughness are degraded. Thus, in the case where Nb is contained, the content amount of Nb is set to 0.001% or more and 0.060% or less. Preferably, the content amount of Nb is 0.005% or more and 0.050% or less. More preferably, the content amount of Nb is 0.010% or more and 0.040% or less.

V: 0.01% or more and 0.50% or less

V is an element having an action of improving the strength of the steel sheet by precipitation strengthening or solid solution strengthening. Further, same as Ti, V raises the recrystallization temperature of the austenite phase at the time of hot rolling, and enables rolling in an austenite un-recrystallized region; thus, contributes to a grain size reduction of the lower bainite phase and/or the tempered martensite phase, and improves low-temperature toughness. To bring out these effects, the content amount of V needs to be set to 0.01% or more. On the other hand, if the content amount of V is more than 0.50%, the generation of martensite-austenite constituent is promoted, and stretch flange formability and low-temperature toughness are degraded. Thus, in the case where V is contained, the content amount of V is set to 0.01% or more and 0.50% or less. Preferably, the content amount of V is 0.05% or more and 0.40% or less. More preferably, the content amount of V is 0.10% or more and 0.30% or less.

Sb: 0.0005% or more and 0.0500% or less

Sb has an effect of suppressing the nitriding of the surface of a slab in a slab heating stage, and suppresses the precipitation of BN in an outer layer portion of the slab. Further, by solid solution B existing, hardenability necessary to generate bainite can be obtained even in an outer layer portion of the hot rolled steel sheet, and the strength of the hot rolled steel sheet is improved. To bring out such effects, the content amount of Sb needs to be set to 0.0005% or more. On the other hand, if the content amount of Sb is more than 0.0500%, an increase in rolling load may be caused, and productivity may be reduced. Thus, in the case where Sb is contained, the content amount of Sb is set to 0.0005% or more and 0.0500% or less. Preferably, the content amount of Sb is 0.0008% or more and 0.0350% or less, and more preferably, the content amount of Sb is 0.0010% or more and 0.0200% or less.

One or two or more selected from Ca: 0.0005% or more and 0.0100% or less, Mg: 0.0005% or more and 0.0100% or less, and REMs: 0.0005% or more and 0.0100% or less Ca: 0.0005% or more and 0.0100% or less Ca controls the shapes of oxide- or sulfide-based inclusions, and is effective to improve the low-temperature toughness of the hot rolled steel sheet. To bring out these effects, the content amount of Ca is preferably set to 0.0005% or more. However, if the content amount of Ca is more than 0.0100%, a surface defect of the hot rolled steel sheet may be brought about, and the bendability of the hot rolled steel sheet is degraded. Thus, in the case where Ca is contained, the content amount of Ca is set to 0.0005% or more and 0.0100% or less. Preferably, the content amount of Ca is 0.0010% or more and 0.0050% or less.

Mg: 0.0005% or more and 0.0100% or less

Mg controls, as same as Ca, the shapes of oxide- or sulfide-based inclusions, and is effective to improve the low-temperature toughness of the hot rolled steel sheet. To bring out these effects, the content amount of Mg is preferably set to 0.0005% or more. However, if the content amount of Mg is more than 0.0100%, conversely the cleanliness of the steel is degraded, and low-temperature toughness is degraded. Thus, in the case where Mg is contained, the content amount of Mg is set to 0.0005% or more and 0.0100% or less. Preferably, the content amount of Mg is 0.0010% or more and 0.0050% or less.

REM: 0.0005% or more and 0.0100% or less

REM controls, as same as Ca, the shapes of oxide- or sulfide-based inclusions, and is effective to improve the low-temperature toughness of the hot rolled steel sheet. To bring out these effects, the content amount of REM is preferably set to 0.0005% or more. However, if the content amount of REM is more than 0.0100%, conversely the cleanliness of the steel is degraded, and low-temperature toughness is degraded. Thus, in the case where REM is contained, the content amount of REM is set to 0.0005% or more and 0.0100% or less. Preferably, the content amount of REM is 0.0010% or more and 0.0050% or less.

In accordance with aspects of the present invention, the balance other than the above includes Fe and incidental impurities. Zr, Co, Sn, Zn, W, etc. are given as incidental impurities, and content amounts of these of 0.2% or less in total can be permitted. In the case where any of the arbitrary elements mentioned above is contained at less than the lower limit value, it is assumed that the arbitrary element contained at less than the lower limit value is contained as an incidental impurity.

Next, the reasons for limiting the steel structure of the high-strength hot rolled steel sheet according to aspects of the present invention and the arithmetic average roughness (Ra) of a surface of the steel sheet are described.

In the steel structure of the high-strength hot rolled steel sheet according to aspects of the present invention, a lower bainite phase and/or a tempered martensite phase at 90% or more in terms of area fraction is contained as a dominant phase, the average grain size of the dominant phase is 10.0 μm or less, the amount of Fe in Fe-based precipitates is set to 0.70% or less in mass %, and the arithmetic average roughness (Ra) of a surface of the steel sheet is 2.50 μm or less. The balance includes a fresh martensite phase, a martensite-austenite constituent phase, a massive retained austenite phase, an upper bainite phase, a pearlite phase, a polygonal ferrite phase, degenerate pearlite, and acicular ferrite; when the area fraction of these phases is 0 to 10% or less in total, the effect according to aspects of the present invention is obtained.

The steel structure of the high-strength hot rolled steel sheet according to aspects of the present invention is as follows.

Dominant phase: the lower bainite phase and/or the tempered martensite phase accounts for 90% or more in terms of the total area fraction, and the average grain size of the lower bainite phase and/or the tempered martensite phase is 10.0 μm or less Amount of Fe in Fe-based precipitates: the amount of Fe in Fe-based precipitates is 0.70% or less in mass %

Balance: the balance excluding the fresh martensite phase, the martensite-austenite constituent phase, the massive retained austenite phase, the upper bainite phase, the pearlite phase, the polygonal ferrite phase, degenerate pearlite, and acicular ferrite accounts for 0% or more and 10% or less in terms of the total area fraction The high-strength hot rolled steel sheet according to aspects of the present invention contains a lower bainite phase and/or a tempered martensite phase as a dominant phase. The lower bainite phase and/or the tempered martensite phase means a structure containing Fe-based carbides in the lath and/or between laths of lath-like ferrite. The orientation and the crystal structure of Fe-based carbides in the lath can be distinguished between lower bainite and tempered martensite by using a TEM; however, in accordance with aspects of the present invention, lower bainite and tempered martensite have substantially the same properties, and are therefore not distinguished. Unlike lamellar ferrite in a pearlite phase or polygonal ferrite, lath-like ferrite has a lath-like shape and has a relatively high dislocation density in the interior; therefore, both can be distinguished by using a SEM or a TEM. To achieve strength of a tensile strength TS of 1180 MPa or more and enhance stretch flange formability and low-temperature toughness, it is necessary that a lower bainite phase and/or a tempered martensite phase be contained as a dominant phase. When the total area fraction of the lower bainite phase and/or the tempered martensite phase is 90% or more and the average grain size of the lower bainite phase and/or the tempered martensite phase is 10.0 μm or less, a tensile strength TS of 1180 MPa or more, and excellent stretch flange formability and low-temperature toughness can be provided at the same time. Thus, the total area fraction of the lower bainite phase and/or the tempered martensite phase is set to 90% or more. The total area fraction of the lower bainite phase and/or the tempered martensite phase is preferably 95% or more, and more preferably more than 97%. The upper limit is not particularly limited, and may be 100%. The average grain size of the lower bainite phase and/or the tempered martensite phase is preferably 9.0 μm or less, and more preferably 8.0 μm or less. Still more preferably, the average grain size is 7.0 μm or less. The average grain size mentioned above is preferably as small as possible, but is often 3.0 μm or more in accordance with aspects of the present invention.

As mentioned above, it is not necessary to distinguish lower bainite and tempered martensite, and the effect according to aspects of the present invention is obtained even when only one of them is contained. Further, it is not necessary that the amount of one of lower bainite and tempered martensite be extremely large, either; thus, the ratio between the area fractions of lower bainite and tempered martensite (lower bainite/tempered martensite) may be 1/5 to 5/1.

In accordance with aspects of the present invention, the amount of Fe in Fe-based precipitates is set to 0.70% or less in mass %. If the amount of Fe of Fe-based precipitates is more than 0.70% in mass % and a large amount of Fe is precipitated, it is likely that voids starting from Fe-based precipitates will be connected during stretch flange forming, and local ductility is reduced and stretch flange formability is reduced. Thus, the amount of Fe in Fe-based precipitates is limited to 0.70% or less in mass %. Preferably, the amount of Fe in Fe-based precipitates is 0.60% or less in mass %. More preferably, the amount of Fe in Fe-based precipitates is 0.50% or less in mass %. Still more preferably, the amount of Fe in Fe-based precipitates is 0.30% or less in mass %. As Fe-based precipitates, η-carbide and ε-carbide are given as well as cementite (θ-carbide).

The structure other than the lower bainite phase and/or the tempered martensite phase, which is a dominant phase, contains a fresh martensite phase, a martensite-austenite constituent phase, a massive retained austenite phase, an upper bainite phase, a pearlite phase, and a polygonal ferrite phase (provided that the case where not all of these phases are contained is included). Further, there is also a case where degenerate pearlite and/or acicular ferrite is contained.

The fresh martensite phase is a structure not containing Fe-based carbides as compared to the tempered martensite phase, and both can be distinguished by using a SEM or a TEM. The fresh martensite phase is poorer in low-temperature toughness than the lower bainite phase and/or the tempered martensite phase.

Martensite-austenite constituent (a martensite-retained austenite mixed phase) is easily generated when the cooling stop temperature (the coiling temperature) is high temperature, and exists to be surrounded by a phase such as a lower bainite phase and/or a tempered martensite phase, an upper bainite phase, or a polygonal ferrite phase. The martensite-austenite constituent phase has a brighter contrast of a SEM image than the lower bainite phase and/or the tempered martensite phase, the upper bainite phase, and the polygonal ferrite phase, and can therefore be distinguished by using a SEM. Similarly, the fresh martensite phase, martensite-austenite constituent is poorer in low-temperature toughness than the lower bainite phase and/or the tempered martensite phase. Further, martensite-austenite constituent contains C distributed from the surrounding phase and has high concentrating of C, and has high strength. In general, if a low-strength phase and a high-strength phase exist in a steel sheet, voids occur at the interface between the low-strength phase and the high-strength phase at the time of a hole expansion test. When generated voids are connected, a crack piercing the sheet thickness is produced in an early stage of the hole expansion test, and hence stretch flange formability is reduced. Thus, if the area fraction of the martensite-austenite constituent phase, which is a high-strength phase, is raised, stretch flange formability is degraded.

Similarly to the martensite-austenite constituent phase, the massive retained austenite phase contains C distributed from the surrounding phase, and is generated with a high C concentration. The C concentration is high during stretch flange forming, and transformation to high-strength fresh martensite occurs; thus, if the area fraction of the massive retained austenite phase is raised, stretch flange formability is degraded.

The upper bainite phase means a structure having a retained austenite phase between laths of lath-like ferrite. The upper bainite phase is generated at a higher temperature than the lower bainite phase and/or the tempered martensite phase, and therefore has low strength. Thus, if the area fraction of the upper bainite phase is raised, a high strength of 1180 MPa or more is not obtained.

A pearlite phase means a structure containing lamellar ferrite and Fe-based carbides. Lamellar ferrite has a lower dislocation density than lath-like ferrite; therefore, the pearlite phase, and the lower bainite phase and/or the tempered martensite phase or the upper bainite phase can be easily distinguished with a SEM, a TEM, or the like. The pearlite phase is poorer in low-temperature toughness than the lower bainite phase and/or the tempered martensite phase.

The polygonal ferrite phase is generated at a higher temperature than the upper bainite phase and is massive, and can therefore be easily distinguished from lath-like ferrite with a SEM, a TEM, or the like. The polygonal ferrite phase has low strength; thus, if the area fraction of the polygonal ferrite phase is raised, a high strength of 1180 MPa or more is not obtained.

The arithmetic average roughness (Ra) of a surface of the steel sheet is 2.50 μm or less If the arithmetic average roughness (Ra) of a surface of the steel sheet is large, local stress concentration may occur in a bending vertex portion during bend forming, and a crack may occur. Thus, to ensure good bendability with a high-strength hot rolled steel sheet, the arithmetic average roughness (Ra) of the surface of the steel sheet is set to 2.50 μm or less. Bendability improves as the arithmetic average roughness (Ra) of the surface of the steel sheet becomes smaller; thus, the arithmetic average roughness (Ra) of the surface of the steel sheet is preferably 2.20 μm or less. More preferably, the arithmetic average roughness (Ra) of the surface of the steel sheet is 2.00 μm or less. Still more preferably, the arithmetic average roughness (Ra) of the surface of the steel sheet is 1.80 μm or less.

Surface treatment of the steel sheet (preferred conditions)

It is possible to employ a surface-treated steel sheet in which a coating layer is provided on a surface of a steel sheet having the structure, etc. mentioned above, for the purpose of an improvement in corrosion resistance, etc. Examples of the coating layer include an electrogalvanized coating layer or the like. The amount of coating adhesion amount is not particularly limited, and may be similar to a conventional one.

The area fraction of each of the lower bainite phase and/or the tempered martensite phase, the fresh martensite phase, the martensite-austenite constituent phase, the massive retained austenite phase, the upper bainite phase, the pearlite phase, the polygonal ferrite phase, degenerate pearlite, and acicular ferrite, the average grain size of the lower bainite phase and/or the tempered martensite phase, the amount of Fe in Fe-based precipitates, and the arithmetic average roughness (Ra) of the surface of the steel sheet described above can be measured by methods described in Examples described later.

Next, properties of the high-strength hot rolled steel sheet according to aspects of the present invention are described.

The high-strength hot rolled steel sheet according to aspects of the present invention has high strength. Specifically, the tensile strength (TS) measured by a method described in Examples is 1180 MPa or more. In accordance with aspects of the present invention, the tensile strength is often 1500 MPa or less.

The high-strength hot rolled steel sheet according to aspects of the present invention has excellent stretch flange formability. Specifically, the hole expansion rate A measured by a method described in Examples is 50% or more. In accordance with aspects of the present invention, the hole expansion rate A is often 90% or less.

The high-strength hot rolled steel sheet according to aspects of the present invention has excellent bendability. Specifically, R/t measured by a method described in Examples is 3.0 or less. In accordance with aspects of the present invention, R/t is often 0.5 or more.

The high-strength hot rolled steel sheet according to aspects of the present invention has excellent low-temperature toughness. Specifically, vTrs measured by a method described in Examples is −40° C. or less. In accordance with aspects of the present invention, vTrs is often −100° C. or more.

Next, a method for manufacturing a high-strength hot rolled steel sheet according to aspects of the present invention is described. In the description, the expression of "° C." regarding temperature indicates the temperature at the surface of the steel sheet or the surface of the steel material.

In the method for manufacturing according to aspects of the present invention, the method including: heating a steel material having the described-above chemical composition to 1150° C. or more; performing rough rolling on the steel material after the heating; performing, before finish rolling to be performed after the rough rolling, high-pressure water descaling under a condition of a collision pressure of 2.5 MPa or more; performing finish rolling on a steel sheet after the high-pressure water descaling under a condition of a finisher delivery temperature of (RC−200° C.) or more and (RC+50° C.) or less, where an RC temperature is defined by Formula (1); starting cooling after an end of the finish rolling, and performing cooling under conditions of a cooling stop temperature of 200° C. or more and an Ms temperature or less, where the Ms temperature is defined by Formula (2), and an average cooling rate of 20° C./s or more, and under a condition of a time from the end of the finish rolling to a start of the cooling of within 2.0 s in a case where the finisher delivery temperature is RC or more; coiling a steel sheet at the cooling stop temperature after the cooling; and cooling the steel sheet under conditions of an average cooling rate of less than 20° C./s and a cooling stop temperature of 100° C. or less after the coiling. In the manufacturing method according to aspects of the present invention, coating treatment may be further performed. Formula (1) and Formula (2) are as described later.

Hereinbelow, a detailed description is given.

In accordance with aspects of the present invention, the method for manufacturing a steel material does not need to be particularly limited, and all methods in common use in which molten steel having the chemical composition mentioned above is smelted by a known method such as a converter and is made into a steel material such as a slab by a casting method such as continuous casting may be used. Also a known casting method such as an ingot making-ingot separation rolling method may be used. Further, scrap may be used as a source material.

Slab after casting: A slab after casting is subjected to direct rolling, or a slab formed as a warm piece or a cold piece (a steel material) is heated to 1150° C. or more In a steel material such as a slab after cooling down to low temperature, most carbonitride-forming elements such as Ti exist as coarse carbonitrides. The existence of the coarse, nonuniform precipitates causes degradation in various properties (for example, strength, low-temperature toughness, etc.) of the hot rolled steel sheet. Thus, the steel material before hot rolling is directly hot rolled (subjected to direct rolling) as it is at high temperature after casting, or the steel material before hot rolling is heated to dissolve the coarse precipitates as solid solution. In the case where a slab is heated, to sufficiently dissolve the coarse precipitates as solid solution before hot rolling, the heating temperature of the steel material needs to be set to 1150° C. or more.

On the other hand, if the heating temperature of the steel material is too high, the occurrence of a flaw of the slab and a yield reduction due to scale-off are caused. Thus, the heating temperature of the steel material is preferably set to 1350° C. or less. The heating temperature of the steel material is more preferably 1180° C. or more and 1300° C. or less, and still more preferably 1200° C. or more and 1280° C. or less.

The steel material is heated to a heating temperature of 1150° C. or more, and is held for a prescribed time; if the holding time is more than 10000 s, the amount of scales generated is increased. As a result, scales being caught or the like is likely to occur in the subsequent hot rolling; consequently, the surface roughness of the hot rolled steel sheet is degraded, and bendability tends to be degraded. Thus, the holding time of the steel material in the temperature region of 1150° C. or more is preferably set to 10000 s or less. More preferably, the holding time of the steel material in the temperature region of 1150° C. or more is 8000 s or less. The lower limit of the holding time is not particularly prescribed; however, from the viewpoint of the uniformity of heating of the slab, the holding time of the steel material in the temperature region of 1150° C. or more is preferably 1800 s or more.

Hot rolling: After rough rolling and before finish rolling, high-pressure water descaling with a collision pressure of 2.5 MPa or more is performed; when an RC temperature in finish rolling is defined by Formula (1), the finisher delivery temperature is set to (RC−200° C.) or more and (RC+50° C.) or less.

$$RC\ (^\circ\ \mathrm{C.}) = 850 + 100\times C + 100\times N + 10\times Mn + 700\times Ti + 5000\times B + 10\times Cr + 50\times Mo + 2000\times Nb + 150\times V \qquad \text{Formula (1)}$$

where each of symbols of elements in Formula (1) is a content amount (mass %) in steel of a respective element, a symbol of an element in the formulae of a not-contained element is set to 0 for calculation.

In accordance with aspects of the present invention, subsequently to the heating of the steel material, hot rolling including rough rolling and finish rolling is performed. In the rough rolling, it is sufficient that required dimensions of a sheet bar be ensured, and the conditions do not need to be particularly limited. After the rough rolling and before the finish rolling, descaling using high-pressure water is performed on the entry side of the finish rolling mill.

Collision pressure of high-pressure water descaling: 2.5 MPa or more

Descaling treatment by high-pressure water jetting is performed in order to remove primary scales that are generated before finish rolling. To control the arithmetic average roughness (Ra) of the surface of the high-strength hot rolled steel sheet to 2.50 μm or less, the collision pressure of high-pressure water descaling needs to be set to 2.5 MPa or more. The upper limit is not particularly prescribed, but preferably, the collision pressure is 15.0 MPa or less. The descaling may also be performed in the course of rolling between stands of finish rolling. Further, the steel sheet may be cooled between stands, as necessary.

In the above, the collision pressure is the force per unit area with which high-pressure water collides with the surface of the steel material. [0092]

Finisher delivery temperature: (RC−200° C.) or more and (RC+50° C.) or less

In the case where the finisher delivery temperature is less than (RC−200° C.), rolling may be performed at a two-phase region temperature of ferrite+austenite; consequently, a desired area fraction of the lower bainite phase and/or the tempered martensite phase is not sufficiently obtained, and a tensile strength TS of 1180 MPa or more and excellent stretch flange formability cannot be ensured. If the finisher delivery temperature is more than (RC+50° C.), the grain growth of austenite grains occurs conspicuously, and austenite grains are coarsened; consequently, the average grain size of the lower bainite phase and/or the tempered martensite phase is increased, and excellent low-temperature toughness required in accordance with aspects of the present invention cannot be ensured. Thus, the finisher delivery temperature is set to (RC−200° C.) or more and (RC+50° C.) or less. The finisher delivery temperature is preferably set to (RC−150° C.) or more and (RC+30° C.) or less. The finisher delivery temperature is more preferably (RC−100° C.) or more and RC or less. The finisher delivery temperature herein refers to the surface temperature of the steel sheet.

Cooling start time: within 2.0 s after the end of finish rolling (in the case where the finisher delivery temperature is RC or more)

In the case where the finisher delivery temperature is RC or higher, forced cooling (occasionally referred to as simply cooling) is started within 2.0 s after the end of finish rolling, the cooling is suspended at a cooling stop temperature (a coiling temperature), and coiling is performed in a coil form. In the case where the finisher delivery temperature is RC or more, if the time from the end of finish rolling to the start of forced cooling is longer than 2.0 s, the grain growth of austenite grains occurs; consequently, the average grain size of the lower bainite phase and/or the tempered martensite phase is increased, and good low-temperature toughness required in accordance with aspects of the present invention is not obtained. Thus, in the case where the finisher delivery temperature is RC or more, the forced cooling start time is set within 2.0 s after the end of finish rolling. In the case where the finisher delivery temperature is less than the RC temperature, the upper limit of the forced cooling start time may not be particularly prescribed. However, the strain introduced in the austenite grain would recover; thus, from the viewpoint of low-temperature toughness, the forced cooling start time is preferably within 2.0 s.

Regardless of the finisher delivery temperature, more preferably the forced cooling start time is within 1.5 s after the end of finish rolling. Still more preferably, the forced cooling start time is within 1.0 s after the end of finish rolling.

Average cooling rate from the finisher delivery temperature to the cooling stop temperature (the coiling temperature): 20° C./s or more In forced cooling, if the average cooling rate from the finisher delivery temperature to the coiling temperature is less than 20° C./s, ferrite transformation or upper bainite transformation occurs before lower bainite transformation or martensite transformation, and a lower bainite phase and/or a tempered martensite phase at a desired area fraction is not obtained. Thus, the average cooling rate is set to 20° C./s or more. The average cooling rate is preferably 25° C./s or more, and more preferably 30° C./s or more. The upper limit of the average cooling rate herein is not particularly prescribed; however, if the average cooling rate is too large, the management of the cooling stop temperature is difficult, and it may be difficult to obtain a desired microstructure. Thus, the average cooling rate is preferably set to 500° C./s or less. The average cooling rate is prescribed on the basis of the average cooling rate at the surface of the steel sheet.

Cooling stop temperature (coiling temperature): 200° C. or more and the Ms temperature or less If the cooling stop temperature (the coiling temperature) is less than 200° C., a fresh martensite phase is generated, and desired excellent low-temperature toughness is not obtained. Thus, the cooling stop temperature (the coiling temperature) is set to 200° C. or more. If the cooling stop temperature (the coiling temperature) is more than an Ms temperature when the Ms temperature is defined by Formula (2), one phase or two phases or more of a massive retained austenite phase, a martensite-austenite constituent phase, an upper bainite phase, a pearlite phase, and a ferrite phase are generated, and a desired high strength of 1180 MPa or more, excellent stretch flange formability, and excellent low-temperature toughness are not obtained. Thus, the cooling stop temperature (the coiling temperature) is set to 200° C. or more and the Ms temperature or less. The cooling stop temperature is preferably 250° C. or more and (Ms−10° C.) or less. The cooling stop temperature is more preferably 300° C. or more and (Ms−20° C.) or less.

$$Ms\ (^\circ\ C.)=560-470\times C-33\times Mn-24\times Cr-17\times Ni-20\times Mo \qquad \text{Formula (2)}$$

where each of symbols of elements in Formula (2) is a content amount (mass %) in steel of a respective element, a symbol of an element in the formulae of a not-contained element is set to 0 for calculation.

After coiling, the hot rolled steel sheet is cooled at an average cooling rate of less than 20° C./s with a cooling stop temperature of 100° C. or less The average cooling rate of the hot rolled steel sheet after coiling influences the tempering behavior of the martensite phase. If the average cooling rate at the time of cooling the hot rolled steel sheet after coiling down to 100° C. is 20° C./s or more, the tempering of the martensite phase is insufficient, and the amount of the fresh martensite phase is increased; consequently, desired excellent low-temperature toughness cannot be obtained. Thus, the average cooling rate of the steel sheet after coiling is set to less than 20° C./s. Preferably, the average cooling rate of the steel sheet after coiling is 2° C./s or less. More preferably, the average cooling rate of the steel sheet after coiling is 0.02° C./s or less. The lower limit of the average cooling rate mentioned above is not particularly limited, but is preferably 0.0001° C./s or more. In this cooling, the cooling stop temperature may be less than 100° C.; usually, cooling is performed down to room temperature of approximately 10 to 30° C.

By the above steps, a high-strength hot rolled steel sheet according to aspects of the present invention is manufactured.

In accordance with aspects of the present invention, segregation reduction treatment such as electromagnetic stirring (EMS) or soft reduction casting (IBSR) may be performed in order to reduce the segregation of components of the steel at the time of continuous casting. By performing electromagnetic stirring treatment, an isometric crystal can be formed in a central portion of the sheet thickness, and segregation can be reduced. In the case where soft reduction casting is performed, segregation in a central portion of the sheet thickness can be reduced by preventing the flowing of molten steel in unsolidified portions of a continuous cast slab. By using at least one of these segregation reduction treatments, press formability and low-temperature toughness described later can be achieved at a more excellent level.

After coiling, in conformity with usual methods, temper rolling may be performed, or pickling may be performed to remove scales formed on the surface. After pickling treatment or after temper rolling, coating treatment or chemical conversion treatment may be further performed by using a galvanization line in common use. For example, a treatment in which the steel sheet is passed through an electro-galvanization line to form a galvanized layer on a surface of the steel sheet may be performed as a coating treatment.

EXAMPLES

Molten steel of each of the chemical compositions shown in Table 1 was smelted by a converter, and a steel slab (a steel material) was manufactured by a continuous casting method. Next, each of the steel materials was heated and subjected to rough rolling under the manufacturing conditions shown in Table 2-1 or Table 2-2, a surface of the steel sheet was descaled under the condition shown in Table 2-1 or Table 2-2, and finish rolling was performed under the condition shown in Table 2-1 or Table 2-2. After the end of the finish rolling, the steel sheet was cooled and coiled using the cooling start time (the time from the end of finish rolling to the start of cooling (forced cooling)), the average cooling rate (the average cooling rate from the finisher delivery temperature to the coiling temperature), and the cooling stop temperature of the conditions shown in Table 2-1 or Table 2-2, and the steel sheet after coiling was cooled down to 100° C. or less at the average cooling rate shown in Table 2-1 or Table 2-2; thus, a hot rolled steel sheet with the sheet thickness shown in Table 2-1 or Table 2-2 was obtained. The hot rolled steel sheet thus obtained was subjected to skin pass rolling, and was then pickled (hydrochloric acid concentration: 10% in mass %; temperature: 85° C.); some hot rolled steel sheets were subjected to electro-galvanization treatment.

Test pieces were extracted from each of the hot rolled steel sheets thus obtained, and the measurement of the arithmetic average roughness (Ra) of a surface of the hot rolled steel sheet, structure observation, the measurement of the amount of Fe in Fe-based precipitates, a tensile test, a hole expansion test, a bending test, and a Charpy impact test were performed. The structure observation method and the various test methods are as follows. In the case of the coated steel sheet, the tests and evaluations were performed with the steel sheet after coating.

(i) Measurement of the arithmetic average roughness (Ra) of a surface of the hot rolled steel sheet A test piece (size: t (sheet thickness; mm)×100 mm (width)×100 mm (length)) for measurement of the arithmetic average roughness of a surface of the steel sheet was extracted from the obtained hot rolled steel sheet, and the arithmetic average roughness (Ra) was measured in conformity with JIS B 0601. The measurement of the arithmetic average roughness (Ra) was performed 25 times with a pitch of 5 mm in each of the rolling direction and a direction at a right angle, and the average value was calculated and evaluated. For the coated sheet, the Ra of the steel sheet after coating was found; for the hot rolled steel sheet, the Ra of the steel sheet after removing scales by pickling was found.

(ii) Structure observation

The area fraction of each structure and the average grain size of the lower bainite phase and/or the tempered martensite phase A test piece for a SEM was extracted from the obtained hot rolled steel sheet, a sheet thickness cross section parallel to the rolling direction was polished, and then the structure was allowed to appear with a corrosive liquid (a 3-mass % nital solution). Ten fields of view were photographed in a position of ¼ of the sheet thickness by using a SEM at a magnification of 5000 times, and image processing was performed to quantify the area fraction (%) of each phase (the lower bainite phase and/or the tempered martensite phase, the upper bainite phase, the pearlite phase, and the polygonal ferrite phase). The fresh martensite phase, the martensite-austenite constituent phase, and the massive retained austenite phase are difficult for the SEM to distinguish; thus, crystal grains that were impossible to distinguish were measured by using an EBSD method. A result of measurement by the EBSD method in which retained austenite was not identified in the crystal grain was distinguished as a fresh martensite phase, a result in which an austenite phase at less than 80% in terms of area fraction was identified in the crystal grain was as an martensite-austenite constituent phase, and a result in which an austenite phase at 80% or more in terms of area fraction was identified in the crystal grain was as a massive retained austenite phase.

In order to measure the average grain size of the lower bainite phase and/or the tempered martensite phase, a test piece for measurement of the grain size of the lower bainite phase and/or the tempered martensite phase by an EBSD method using a SEM was extracted from the obtained hot rolled steel sheet. A surface parallel to the rolling direction was taken as an observation surface, and was subjected to finish polishing using a colloidal silica solution. After that, an EBSD measurement apparatus was used to measure ten places in a position of ¼ of the sheet thickness in a 100 μm×100 μm area, with an accelerating voltage of the electron beam of 20 keV and measurement intervals of 0.1μm steps. The threshold of a large angle boundary that is generally recognized as a crystal grain boundary was defined as 15°; grain boundaries with crystal orientation differences of 15° or more were visualized, and the average grain size of the lower bainite phase and/or the tempered martensite phase was calculated. The area average (area fraction average) grain size of the lower bainite phase and/or the tempered martensite phase is calculated by using an OIM Analysis software application manufactured by TSL K.K. At this time, the area average grain size (referred to as the average grain size) can be found by setting the grain tolerance angle to 15° as the definition of the crystal grain.

Measurement of the amount of Fe in Fe-based precipitates

A test piece extracted from the obtained hot rolled steel sheet was set as a positive pole and constant current electrolysis was performed in a 10% AA-based electrolytic solution, and a certain amount of the test piece was dissolved. After that, the extraction residue obtained by the electrolysis was filtered out by using a filter with a hole diameter of 0.2 μm, and Fe-based precipitates were collected. Subsequently, the obtained Fe-based precipitates were dissolved by using a mixed acid, then Fe was quantified by an ICP emission spectroscopic analysis method, and the measurement value was used to calculate the amount of Fe in the Fe precipitates. Since Fe-based precipitates are condensed, even Fe-based precipitates with grain sizes of less than 0.2 μm can be collected by performing filtration using a filter with a hole diameter of 0.2 μm.

(iii) Tensile test

A JIS No.5 test piece (GL: 50 mm) was extracted from the obtained hot rolled steel sheet in such a manner that the tensile direction was a direction at a right angle to the rolling direction, and a tensile test was performed in conformity with the provision of JIS Z 2241 to find the yield strength (the yield point, YP), the tensile strength (TS), the yield ratio (YR), and the total elongation (El). The test was performed twice for each hot rolled steel sheet, and the average values were taken as mechanical characteristic values of the steel sheet.

(iv) Hole expansion test

A test piece for a hole expansion test (size: t (sheet thickness; mm)×100 mm (width)×100 mm (length)) was taken from the obtained hot rolled steel sheet; in conformity with a standard of The Japan Iron and Steel Federation, JFS T 1001, a punch hole was punched at the center of the test piece by using a 10-mm-diameter punch with a clearance of 12%±1%, then a 60° conical punch was inserted into the punched hole so as to be pushed up from the punching direction, the hole diameter d (mm) at the time point when a crack pierced the sheet thickness was found, and a hole expansion rate λ (%) defined by the following formula was calculated.

$$\lambda\ (\%)=\{(d-10)/10\}\times 100$$

The clearance is the proportion (%) of the gap between the die and the punch to the sheet thickness. In accordance with aspects of the present invention, the case where the A obtained by the hole expansion test was 50% or more was evaluated as stretch flange formability being good.

(v) Bending test

The obtained hot rolled steel sheet was subjected to shearing processing to extract 35 mm (width)×100 mm (length) bending test pieces in such a manner that the longitudinal direction of the test piece was at a right angle to the rolling direction. Using the test pieces each having a shearing end surface, a V-block 90° bending test was performed in conformity with a pressing bend method provided in JIS Z 2248. At this time, the test was performed using three test pieces for each steel sheet; the smallest bending radius among those with which a crack did not occur in any test piece was taken as the limit bending radius R (mm), and an R/t value obtained by dividing R by the sheet thickness t (mm) of the hot rolled steel sheet was found to evaluate the bendability of the hot rolled steel sheet. In accordance with aspects of the present invention, the case where the value of R/t was 3.5 or less was evaluated as being excellent in bendability. The value of R/t is more preferably 3.0 or less, and still more preferably 2.5 or less.

(vi) Charpy impact test

A sub-size test piece (V-notch) with a thickness of 2.5 mm was extracted from the obtained hot rolled steel sheet in such a manner that the longitudinal direction of the test piece was at a right angle to the rolling direction; a Charpy impact test was performed in conformity with the provision of JIS Z 2242, and a brittle ductile fracture appearance transition temperature (vTrs) was measured to evaluate toughness. Here, for the hot rolled steel sheet with a sheet thickness of more than 2.5 mm, a test piece was produced by grinding both surfaces to set the sheet thickness to 2.5 mm; for the hot rolled steel sheet with a sheet thickness of 2.5 mm or less, a test piece was produced with the original thickness; then, these test pieces were used for the Charpy impact test. In accordance with aspects of the present invention, the case where the measured vTrs was −40° C. or less was evaluated as low-temperature toughness being good.

The results obtained by the above tests and evaluations are shown in Table 3-1 and Table 3-2.

TABLE 1

| | Chemical composition (mass %) | | | | | | | | | | | |
|---|---|---|---|---|---|---|---|---|---|---|---|---|
| Steel | C | Si | Mn | P | S | Al | N | Ti | B | Cr | Nb | V |
| A | 0.073 | 0.92 | 1.83 | 0.015 | 0.0010 | 0.042 | 0.0050 | 0.154 | 0.0020 | 0.38 | | |
| B | 0.192 | 1.23 | 0.84 | 0.010 | 0.0008 | 0.040 | 0.0041 | 0.075 | 0.0015 | 0.35 | | |
| C | 0.125 | 0.82 | 2.21 | 0.011 | 0.0007 | 0.061 | 0.0056 | 0.073 | 0.0015 | | | |
| D | 0.098 | 0.24 | 2.35 | 0.010 | 0.0009 | 0.050 | 0.0045 | 0.052 | 0.0013 | 0.41 | | |
| E | 0.121 | 1.93 | 1.45 | 0.015 | 0.0013 | 0.038 | 0.0035 | 0.065 | 0.0015 | 0.11 | | |
| F | 0.113 | 0.75 | 1.82 | 0.015 | 0.0010 | 0.045 | 0.0045 | 0.103 | 0.0018 | 0.27 | | |
| G | 0.120 | 0.81 | 2.91 | 0.005 | 0.0006 | 0.040 | 0.0035 | 0.032 | 0.0025 | 0.89 | | |
| H | 0.131 | 0.28 | 1.95 | 0.009 | 0.0017 | 1.910 | 0.0055 | 0.113 | 0.0006 | 0.15 | | |
| I | 0.147 | 0.63 | 1.74 | 0.011 | 0.0009 | 0.050 | 0.0040 | 0.127 | 0.0017 | 0.34 | | |
| J | 0.093 | 0.55 | 1.15 | 0.008 | 0.0006 | 0.040 | 0.0028 | 0.077 | 0.0095 | 1.91 | | |
| K | 0.088 | 0.43 | 1.96 | 0.014 | 0.0023 | 0.047 | 0.0038 | 0.060 | 0.0010 | 0.13 | 0.03 | |
| L | 0.145 | 0.51 | 1.65 | 0.013 | 0.0009 | 0.043 | 0.0040 | 0.053 | 0.0015 | | | 0.280 |
| M | 0.113 | 0.82 | 1.55 | 0.019 | 0.0018 | 0.041 | 0.0098 | 0.045 | 0.0007 | 0.35 | | |
| N | 0.125 | 0.74 | 1.60 | 0.034 | 0.0008 | 0.041 | 0.0041 | 0.060 | 0.0025 | | | |
| O | 0.115 | 0.69 | 1.83 | 0.029 | 0.0012 | 0.031 | 0.0044 | 0.080 | 0.0017 | 0.55 | | |
| P | 0.137 | 0.93 | 2.21 | 0.012 | 0.0039 | 0.028 | 0.0035 | 0.102 | 0.0016 | 0.73 | | |
| Q | 0.175 | 1.00 | 1.25 | 0.025 | 0.0031 | 0.045 | 0.0055 | 0.040 | 0.0019 | 0.91 | | |
| a | 0.061 | 0.41 | 1.95 | 0.013 | 0.0012 | 0.052 | 0.0037 | 0.115 | 0.0015 | 0.35 | | |
| b | 0.210 | 0.25 | 1.38 | 0.020 | 0.0015 | 0.065 | 0.0042 | 0.043 | 0.0019 | 0.21 | | |
| c | 0.150 | 0.05 | 1.92 | 0.010 | 0.0015 | 0.047 | 0.0062 | 0.063 | 0.0014 | 0.11 | | |
| d | 0.091 | 2.08 | 1.23 | 0.016 | 0.0017 | 0.055 | 0.0038 | 0.042 | 0.0019 | 0.14 | | |

TABLE 1-continued

| | | | | | | | | | | |
|---|---|---|---|---|---|---|---|---|---|---|
| e | 0.110 | 0.55 | 0.73 | 0.016 | 0.0015 | 0.045 | 0.0042 | 0.082 | 0.0026 | 0.45 |
| f | 0.092 | 0.95 | 3.15 | 0.009 | 0.0009 | 0.051 | 0.0036 | 0.120 | 0.0020 | 0.43 |
| g | 0.153 | 0.32 | 2.25 | 0.108 | 0.0014 | 0.042 | 0.0041 | 0.054 | 0.0008 | 0.23 |
| h | 0.112 | 0.58 | 2.12 | 0.012 | 0.0105 | 0.066 | 0.0063 | 0.072 | 0.0026 | 0.42 |
| i | 0.103 | 0.95 | 1.75 | 0.023 | 0.0009 | 2.135 | 0.0025 | 0.098 | 0.0012 | 0.51 |
| j | 0.095 | 1.15 | 1.88 | 0.016 | 0.0021 | 0.052 | 0.0110 | 0.102 | 0.0041 | 0.13 |
| k | 0.125 | 0.56 | 1.71 | 0.025 | 0.0010 | 0.038 | 0.0050 | 0.011 | 0.0010 | 0.24 |
| l | 0.107 | 0.95 | 1.87 | 0.021 | 0.0045 | 0.028 | 0.0036 | 0.164 | | |

| | Chemical composition (mass %) | | | | | | | |
|---|---|---|---|---|---|---|---|---|
| Steel | Mo | Cu | Ni | Sb | Ca | REM | Mg | Remarks |
| A | | | | | | | | Steel of the present invention |
| B | | | | | | | | Steel of the present invention |
| C | | | | | | | | Steel of the present invention |
| D | | | | | | | | Steel of the present invention |
| E | | | | | | | | Steel of the present invention |
| F | | | | | | | | Steel of the present invention |
| G | | | | | | | | Steel of the present invention |
| H | | | | | | | | Steel of the present invention |
| I | | | | | | | | Steel of the present invention |
| J | | | | | | | | Steel of the present invention |
| K | | | | | | | | Steel of the present invention |
| L | | | | | | | | Steel of the present invention |
| M | 0.15 | | | | | | | Steel of the present invention |
| N | | 0.210 | 0.110 | | | | | Steel of the present invention |
| O | | | | 0.020 | | | | Steel of the present invention |
| P | | | | 0.002 | 0.004 | | | Steel of the present invention |
| Q | | | | | | 0.004 | 0.002 | Steel of the present invention |
| a | | | | | | | | Steel of Comparative example |
| b | | | | | | | | Steel of Comparative example |
| c | | | | | | | | Steel of Comparative example |
| d | | | | | | | | Steel of Comparative example |
| e | | | | | | | | Steel of Comparative example |
| f | | | | | | | | Steel of Comparative example |
| g | | | | | | | | Steel of Comparative example |
| h | | | | | | | | Steel of Comparative example |
| i | | | | | | | | Steel of Comparative example |
| j | | | | | | | | Steel of Comparative example |
| k | | | | | | | | Steel of Comparative example |
| l | | | | | | | | Steel of Comparative example |

Remark: Parts underlined is out of the scope of the present invention

TABLE 2-1

| | | | | | | Cooling | | |
|---|---|---|---|---|---|---|---|---|
| Hot rolled steel sheet No. | Steel | Slab heating temperature (° C.) | Slab heating time (s) at 1150° C. or more | Collision pressure of high-pressure water descaling (MPa) | Finish rolling Finisher delivery temperature (° C.) | Cooling start time (s) (*1) | Average cooling rate (° C./s) (*2) | Cooling suspension Temperature (° C.) |
| 1 | A | 1230 | 3000 | 9.5 | 950 | 0.5 | 28 | 285 |
| 2 | A | 1250 | 3600 | 8.5 | 960 | 1.0 | 77 | 320 |
| 3 | B | 1270 | 4200 | 8.0 | 925 | 0.5 | 36 | 390 |
| 4 | B | 1220 | 3600 | 12.5 | 910 | 1.5 | 17 | 375 |
| 5 | C | 1200 | 3000 | 10.0 | 900 | 0.5 | 46 | 170 |
| 6 | C | 1170 | 2100 | 7.5 | 895 | 1.5 | 28 | 345 |
| 7 | C | 1220 | 3600 | 6.0 | 930 | 0.5 | 33 | 400 |
| 8 | C | 1250 | 4200 | 8.5 | 915 | 1.0 | 72 | 365 |
| 9 | D | 1340 | 3000 | 2.5 | 950 | 1.0 | 91 | 220 |
| 10 | D | 1280 | 4800 | 3.5 | 1000 | 0.5 | 38 | 305 |
| 11 | E | 1190 | 2400 | 11.5 | 910 | 0.5 | 27 | 410 |
| 12 | E | 1240 | 4200 | 14.5 | 970 | 3.0 | 31 | 395 |
| 13 | F | 1230 | 3600 | 6.5 | 925 | 1.0 | 22 | 355 |
| 14 | F | 1200 | 3000 | 6.0 | 920 | 1.5 | 43 | 335 |
| 15 | F | 1270 | 4200 | 9.5 | 950 | 0.5 | 47 | 395 |
| 16 | F | 1220 | 3000 | 9.0 | 900 | 0.5 | 44 | 405 |
| 17 | F | 1120 | 0 | 5.5 | 895 | 0.5 | 37 | 360 |
| 19 | G | 1200 | 9600 | 10.5 | 980 | 0.5 | 98 | 365 |
| 20 | G | 1220 | 4800 | 11.0 | 920 | 1.0 | 35 | 470 |
| 21 | H | 1210 | 3000 | 9.5 | 950 | 0.5 | 29 | 350 |
| 22 | I | 1240 | 4800 | 5.5 | 955 | 1.0 | 42 | 400 |
| 23 | I | 1220 | 3600 | 5.5 | 950 | 1.0 | 49 | 405 |
| 24 | I | 1250 | 5400 | 6.0 | 960 | 0.5 | 42 | 385 |

TABLE 2-1-continued

| | | | | | | | | |
|---|---|---|---|---|---|---|---|---|
| 25 | I | 1170 | 2100 | 5.5 | 780 | 1.5 | 22 | 405 |
| 26 | I | 1260 | 4800 | 1.5 | 950 | 1.0 | 54 | 395 |

| Hot rolled steel sheet No. | Average cooling rate (° C./s) up to 100° C. after coiling (*3) | Presence of coating treatment (*4) | Sheet thickness (mm) | RC (° C.) (*5) | Ms (° C.) (*6) | Remarks |
|---|---|---|---|---|---|---|
| 1 | <0.02 | — | 4.0 | 998 | 456 | Inventive example |
| 2 | <0.02 | — | 2.3 | 998 | 456 | Inventive example |
| 3 | <0.02 | — | 2.6 | 942 | 434 | Inventive example |
| 4 | <0.02 | — | 5.0 | 942 | 434 | Comparative example |
| 5 | <0.02 | — | 2.9 | 944 | 428 | Comparative example |
| 6 | <0.02 | — | 4.0 | 944 | 428 | Inventive example |
| 7 | <0.02 | — | 3.2 | 944 | 428 | Inventive example |
| 8 | <0.02 | ○ | 2.0 | 944 | 428 | Inventive example |
| 9 | 16 | — | 2.3 | 931 | 427 | Inventive example |
| 10 | <0.02 | — | 4.0 | 931 | 427 | Comparative example |
| 11 | <0.02 | — | 2.9 | 931 | 453 | Inventive example |
| 12 | <0.02 | — | 2.9 | 931 | 453 | Comparative example |
| 13 | <0.02 | — | 5.0 | 964 | 440 | Inventive example |
| 14 | <0.02 | — | 3.2 | 964 | 440 | Inventive example |
| 15 | <0.02 | — | 2.6 | 964 | 440 | Inventive example |
| 16 | <0.02 | ○ | 2.3 | 964 | 440 | Inventive example |
| 17 | <0.02 | — | 4.0 | 964 | 440 | Comparative example |
| 19 | <0.02 | — | 1.8 | 935 | 386 | Inventive example |
| 20 | <0.02 | — | 2.6 | 935 | 386 | Comparative example |
| 21 | 1.4 | — | 3.5 | 967 | 430 | Inventive example |
| 22 | <0.02 | — | 2.9 | 983 | 425 | Inventive example |
| 23 | <0.02 | ○ | 2.3 | 983 | 425 | Inventive example |
| 24 | 25 | — | 3.2 | 983 | 425 | Comparative example |
| 25 | <0.02 | — | 3.6 | 983 | 425 | Comparative example |
| 26 | <0.02 | — | 2.6 | 983 | 425 | Comparative example |

(*1) Time from the end of finish rolling to the start of cooling (forced cooling)

(*2) Average cooling rate from the finisher delivery temperature to the coiling temperature (the cooling stop temperature)

(*3) Average cooling rate from the coiling temperature (the cooling suspension time) to the temperature of 100° C. or less (*4) Presence of coating treatment ○: Present, –: Absent (*5) RC(° C.) = 850 + 100 × C + 100 × N + 10 × Mn + 700 × Ti + 5000 × B + 10 × Cr + 50 × Mo + 2000 × Nb + 150 × V . . . Formula (1)

Each of symbols of elements in Formula (1) is a content amount (mass %) in steel of a respective element. If not contained, 0 is set for calculation.

(*6) Ms(° C.) = 560 − 470 × C − 33 × Mn − 24 × Cr − 17 × Ni − 20 × Mo . . . Formula (2)

Each of symbols of elements in Formula (2) is a content amount (mass %) in steel of a respective element. If not contained, 0 is set for calculation.

TABLE 2-2

| Hot rolled steel sheet No. | Steel | Slab heating temperature (° C.) | Slab heating time (s) at 1150° C. or more | Collision pressure of high-pressure water descaling (MPa) | Finish rolling Finisher delivery temperature (° C.) | Cooling: Cooling start time (s) (*1) | Cooling: Average cooling rate (° C./s) (*2) |
|---|---|---|---|---|---|---|---|
| 27 | J | 1160 | 1800 | 12.5 | 800 | 1.0 | 48 |
| 28 | K | 1270 | 5400 | 5.5 | 930 | 1.0 | 54 |
| 29 | L | 1220 | 4200 | 3.5 | 900 | 0.5 | 41 |
| 30 | M | 1230 | 4800 | 5.5 | 830 | 1.0 | 26 |
| 31 | N | 1190 | 3000 | 9.5 | 790 | 1.0 | 22 |
| 32 | O | 1220 | 4200 | 8.5 | 925 | 0.5 | 36 |
| 33 | P | 1250 | 5400 | 10.0 | 930 | 0.0 | 48 |
| 34 | Q | 1260 | 6000 | 10.0 | 955 | 1.0 | 47 |
| 35 | a | 1250 | 4200 | 5.5 | 930 | 1.0 | 43 |
| 36 | b | 1230 | 3600 | 6.0 | 920 | 1.5 | 28 |
| 37 | c | 1250 | 4800 | 5.0 | 935 | 0.5 | 31 |
| 38 | d | 1200 | 3000 | 12.5 | 895 | 1.0 | 40 |
| 39 | e | 1220 | 3600 | 5.5 | 905 | 1.0 | 49 |
| 40 | f | 1250 | 5400 | 9.5 | 920 | 1.5 | 37 |
| 41 | g | 1220 | 3600 | A crack occurred during hot rolling | | | |
| 42 | h | 1220 | 3600 | 10.0 | 905 | 1.0 | 35 |
| 43 | i | 1220 | 4200 | 10.0 | 940 | 0.5 | 31 |

TABLE 2-2-continued

| | | | | | | | |
|---|---|---|---|---|---|---|---|
| 44 | j | 1250 | 5400 | 10.0 | 935 | 0.5 | 30 |
| 45 | k | 1240 | 4800 | 5.0 | 920 | 0.5 | 41 |
| 46 | l | 1280 | 6000 | 7.0 | 940 | 0.5 | 41 |

| Hot rolled steel sheet No. | Cooling Cooling suspension Temperature (° C.) | Average cooling rate (° C./s) up to 100° C. after coiling (*3) | Presence of coating treatment (*4) | Sheet thickness (mm) | RC (° C.) (*5) | Ms (° C.) (*6) | Remarks |
|---|---|---|---|---|---|---|---|
| 27 | 400 | <0.02 | — | 2.3 | 992 | 433 | Inventive example |
| 28 | 355 | <0.02 | — | 2.6 | 987 | 451 | Inventive example |
| 29 | 345 | <0.02 | — | 2.9 | 968 | 437 | Inventive example |
| 30 | 335 | <0.02 | — | 3.2 | 924 | 444 | Inventive example |
| 31 | 365 | <0.02 | — | 4.0 | 933 | 447 | Inventive example |
| 32 | 345 | <0.02 | — | 3.2 | 950 | 432 | Inventive example |
| 33 | 395 | <0.02 | — | 2.9 | 973 | 405 | Inventive example |
| 34 | 385 | <0.02 | — | 2.6 | 927 | 415 | Inventive example |
| 35 | 305 | <0.02 | — | 2.9 | 967 | 459 | Comparative example |
| 36 | 355 | <0.02 | — | 2.9 | 927 | 411 | Comparative example |
| 37 | 345 | <0.02 | — | 3.2 | 937 | 424 | Comparative example |
| 38 | 340 | <0.02 | — | 2.6 | 912 | 473 | Comparative example |
| 39 | 295 | <0.02 | — | 4.0 | 944 | 473 | Comparative example |
| 40 | 380 | <0.02 | — | 3.2 | 989 | 402 | Comparative example |
| 41 | A crack occurred during hot rolling | | | | 932 | 408 | Comparative example |
| 42 | 350 | <0.02 | — | 2.9 | 951 | 427 | Comparative example |
| 43 | 360 | <0.02 | — | 3.2 | 958 | 442 | Comparative example |
| 44 | 350 | <0.02 | — | 4.0 | 973 | 450 | Comparative example |
| 45 | 355 | <0.02 | — | 3.2 | 895 | 439 | Comparative example |
| 46 | 295 | <0.02 | — | 2.9 | 995 | 448 | Comparative example |

(*1) Time from the end of finish rolling to the start of cooling (forced cooling)

(*2) Average cooling rate from the finisher delivery temperature to the coiling temperature (the cooling stop temperature)

(*3) Average cooling rate from the coiling temperature (the cooling suspension time) to the temperature of 100° C. or less (*4) Presence of coating treatment ○: Present, —: Absent (*5) RC(° C.) = 850 + 100 × C + 100 × N + 10 × Mn + 700 × Ti + 5000 × B + 10 × Cr + 50 × Mo + 2000 × Nb + 150 × V . . . Formula (1)

Each of symbols of elements in Formula (1) is a content amount (mass %) in steel of a respective element. If not contained, 0 is set for calculation.

(*6) Ms(° C.) = 560 − 470 × C − 33 × Mn − 24 × Cr − 17 × Ni − 20 × Mo . . . Formula (2)

Each of symbols of elements in Formula (2) is a content amount (mass %) in steel of a respective element. If not contained, 0 is set for calculation.

TABLE 3-1

| | | Structure of hot rolled steel sheet | | | | | | | | |
|---|---|---|---|---|---|---|---|---|---|---|
| Hot rolled steel sheet No. | Steel | The lower bainite phase and/or the tempered martensite phase area fraction (%) | Fresh martensite phase area fraction (%) | Martensite-austenite constituent phase area fraction (%) | Massive retained austenite phase area fraction (%) | Upper bainite phase area fraction (%) | Pearlite phase area fraction (%) | Polygonal ferrite phase area fraction (%) | Average grain size of the lower bainite phase and/or the tempered martensite phase (μm) | Amount of Fe of Fe-based precipitates (in mass %) |
| 1 | A | 95 | 0 | 5 | 0 | 0 | 0 | 0 | 6.7 | 0.12 |
| 2 | A | 96 | 0 | 4 | 0 | 0 | 0 | 0 | 7.7 | 0.11 |
| 3 | B | 93 | 5 | 2 | 0 | 0 | 0 | 0 | 7.0 | 0.66 |
| 4 | B | 80 | 2 | 2 | 1 | 10 | 0 | 5 | 6.5 | 0.65 |
| 5 | C | 85 | 15 | 0 | 0 | 0 | 0 | 0 | 7.0 | 0.15 |
| 6 | C | 100 | 0 | 0 | 0 | 0 | 0 | 0 | 6.3 | 0.22 |
| 7 | C | 98 | 0 | 1 | 1 | 0 | 0 | 0 | 7.1 | 0.31 |
| 8 | C | 100 | 0 | 0 | 0 | 0 | 0 | 0 | 7.4 | 0.24 |
| 9 | D | 94 | 6 | 0 | 0 | 0 | 0 | 0 | 9.1 | 0.53 |
| 10 | D | 100 | 0 | 0 | 0 | 0 | 0 | 0 | 12.4 | 0.58 |
| 11 | E | 98 | 1 | 1 | 0 | 0 | 0 | 0 | 6.6 | 0.28 |
| 12 | E | 100 | 0 | 0 | 0 | 0 | 0 | 0 | 11.1 | 0.27 |
| 13 | F | 96 | 0 | 0 | 0 | 4 | 0 | 0 | 6.4 | 0.21 |
| 14 | F | 100 | 0 | 0 | 0 | 0 | 0 | 0 | 6.1 | 0.20 |
| 15 | F | 96 | 2 | 1 | 1 | 0 | 0 | 0 | 7.2 | 0.30 |
| 16 | F | 100 | 0 | 0 | 0 | 0 | 0 | 0 | 6.1 | 0.32 |
| 17 | F | 89 | 0 | 0 | 0 | 11 | 0 | 0 | 6.2 | 0.26 |
| 19 | G | 93 | 7 | 0 | 0 | 0 | 0 | 0 | 8.2 | 0.19 |
| 20 | G | 48 | 10 | 5 | 2 | 30 | 5 | 0 | 7.2 | 0.64 |

TABLE 3-1-continued

| | | | | | | | | | | |
|---|---|---|---|---|---|---|---|---|---|---|
| 21 | H | 96 | 4 | 0 | 0 | 0 | 0 | 0 | 8.1 | 0.12 |
| 22 | I | 98 | 0 | 2 | 0 | 0 | 0 | 0 | 6.3 | 0.45 |
| 23 | I | 99 | 0 | 1 | 0 | 0 | 0 | 0 | 6.5 | 0.46 |
| 24 | I | 75 | 25 | 0 | 0 | 0 | 0 | 0 | 7.5 | 0.11 |
| 25 | I | 85 | 0 | 0 | 0 | 0 | 0 | 15 | 5.4 | 0.37 |
| 26 | I | 100 | 0 | 0 | 0 | 0 | 0 | 0 | 7.8 | 0.42 |

| | Surface of hot rolled steel sheet | Mechanical properties of hot rolled steel sheet | | | | | | | |
|---|---|---|---|---|---|---|---|---|---|
| Hot rolled steel sheet No. | Arithmetic average roughness Ra (μm) | Yield point YP (MPa) | Tensile strength TS (MPa) | Yield ratio YR (%) | Total elongation El (%) | Hole expansion test λ (%) | Limit bending radius/sheet thickness R/t | vTrs (° C.) | Remarks |
| 1 | 1.15 | 1065 | 1225 | 86.9 | 8.2 | 52 | 1.8 | −45 | Inventive example |
| 2 | 1.23 | 1037 | 1190 | 87.1 | 9.0 | 56 | 1.7 | −50 | Inventive example |
| 3 | 1.75 | 1070 | 1183 | 90.4 | 6.6 | 51 | 2.5 | −45 | Inventive example |
| 4 | 1.35 | 975 | 1123 | 86.8 | 10.3 | 53 | 1.6 | −68 | Comparative example |
| 5 | 1.12 | 1114 | 1314 | 84.8 | 7.2 | 56 | 1.9 | 0 | Comparative example |
| 6 | 1.05 | 1186 | 1263 | 93.9 | 7.9 | 65 | 1.5 | −60 | Inventive example |
| 7 | 1.32 | 1088 | 1186 | 91.7 | 10.8 | 72 | 1.9 | −60 | Inventive example |
| 8 | 1.42 | 1169 | 1242 | 94.1 | 7.8 | 64 | 2.0 | −55 | Inventive example |
| 9 | 1.23 | 1126 | 1254 | 89.8 | 7.0 | 62 | 2.0 | −45 | Inventive example |
| 10 | 1.67 | 1082 | 1218 | 88.8 | 9.2 | 55 | 2.3 | −15 | Comparative example |
| 11 | 1.87 | 1080 | 1196 | 90.3 | 12.5 | 61 | 2.6 | −50 | Inventive example |
| 12 | 2.03 | 1092 | 1212 | 90.1 | 11.8 | 63 | 2.8 | −20 | Comparative example |
| 13 | 1.42 | 1118 | 1237 | 90.4 | 9.4 | 70 | 2.0 | −70 | Inventive example |
| 14 | 1.21 | 1135 | 1257 | 90.3 | 7.6 | 72 | 1.9 | −65 | Inventive example |
| 15 | 1.49 | 1065 | 1189 | 89.6 | 9.9 | 66 | 2.1 | −55 | Inventive example |
| 16 | 1.15 | 1058 | 1186 | 89.2 | 10.2 | 75 | 1.7 | −80 | Inventive example |
| 17 | 1.05 | 1028 | 1148 | 89.5 | 12.1 | 63 | 1.5 | −90 | Comparative example |
| 19 | 2.37 | 1101 | 1223 | 90.0 | 9.0 | 59 | 3.3 | −40 | Inventive example |
| 20 | 1.55 | 914 | 1095 | 83.5 | 14.2 | 26 | 1.9 | −10 | Comparative example |
| 21 | 1.38 | 1185 | 1287 | 92.1 | 8.2 | 69 | 2.1 | −45 | Inventive example |
| 22 | 1.72 | 1068 | 1197 | 89.2 | 8.5 | 55 | 2.2 | −60 | Inventive example |
| 23 | 1.38 | 1064 | 1192 | 89.3 | 8.4 | 58 | 1.7 | −70 | Inventive example |
| 24 | 1.85 | 1081 | 1290 | 83.8 | 7.9 | 52 | 2.8 | 20 | Comparative example |
| 25 | 1.25 | 921 | 1133 | 81.3 | 12.5 | 39 | 1.7 | −80 | Comparative example |
| 26 | 2.73 | 1072 | 1203 | 89.1 | 8.1 | 62 | 3.7 | −60 | Comparative example |

TABLE 3-2

| | | Structure of hot rolled steel sheet | | | | | | | | |
|---|---|---|---|---|---|---|---|---|---|---|
| Hot rolled steel sheet No. | Steel | The lower bainite phase and/or the tempered martensite phase area fraction (%) | Fresh martensite phase area fraction (%) | Martensite-austenite constituent phase area fraction (%) | Massive retained austenite phase area fraction (%) | Upper bainite phase area fraction (%) | Pearlite phase area fraction (%) | Polygonal ferrite phase area fraction (%) | Average grain size of the lower bainite phase and/or the tempered martensite phase (μm) | Amount of Fe of Fe-based precipitates (in mass %) |
| 27 | J | 93 | 7 | 0 | 0 | 0 | 0 | 0 | 4.6 | 0.29 |
| 28 | K | 100 | 0 | 0 | 0 | 0 | 0 | 0 | 5.8 | 0.26 |
| 29 | L | 100 | 0 | 0 | 0 | 0 | 0 | 0 | 6.6 | 0.52 |
| 30 | M | 100 | 0 | 0 | 0 | 0 | 0 | 0 | 5.9 | 0.38 |
| 31 | N | 100 | 0 | 0 | 0 | 0 | 0 | 0 | 5.7 | 0.33 |
| 32 | O | 100 | 0 | 0 | 0 | 0 | 0 | 0 | 6.8 | 0.27 |
| 33 | P | 100 | 0 | 0 | 0 | 0 | 0 | 0 | 7.5 | 0.52 |
| 34 | Q | 100 | 0 | 0 | 0 | 0 | 0 | 0 | 9.4 | 0.32 |
| 35 | a | 85 | 0 | 0 | 0 | 15 | 0 | 0 | 7.8 | 0.20 |
| 36 | b | 95 | 5 | 0 | 0 | 0 | 0 | 0 | 9.0 | 0.82 |
| 37 | c | 100 | 0 | 0 | 0 | 0 | 0 | 0 | 8.7 | 0.79 |
| 38 | d | 94 | 0 | 2 | 4 | 0 | 0 | 0 | 8.2 | 0.11 |
| 39 | e | 87 | 0 | 0 | 0 | 13 | 0 | 0 | 8.0 | 0.13 |
| 40 | f | 82 | 18 | 0 | 0 | 0 | 0 | 0 | 7.1 | 0.23 |
| 41 | g | A crack occurred during hot rolling | | | | | | | | |
| 42 | h | 100 | 0 | 0 | 0 | 0 | 0 | 0 | 7.3 | 0.24 |
| 43 | i | 93 | 0 | 5 | 2 | 0 | 0 | 0 | 8.6 | 0.23 |
| 44 | j | 100 | 0 | 0 | 0 | 0 | 0 | 0 | 8.2 | 0.15 |

TABLE 3-2-continued

| | | | | | | | | | | |
|---|---|---|---|---|---|---|---|---|---|---|
| 45 | k | 88 | 0 | 0 | 0 | 7 | 0 | 5 | 9.2 | 0.37 |
| 46 | l | 88 | 2 | 10 | 0 | 0 | 0 | 0 | 8.4 | 0.18 |

| | Surface of hot rolled steel sheet | Mechanical properties of hot rolled steel sheet | | | | | | | |
|---|---|---|---|---|---|---|---|---|---|
| Hot rolled steel sheet No. | Arithmetic average roughness Ra (μm) | Yield point YP (MPa) | Tensile strength TS (MPa) | Yield ratio YR (%) | Total elongation El (%) | Hole expansion test λ (%) | Limit bending radius/sheet thickness R/t | vTrs (° C.) | Remarks |
| 27 | 1.75 | 978 | 1184 | 82.6 | 8.5 | 64 | 2.4 | −80 | Inventive example |
| 28 | 1.65 | 1147 | 1234 | 92.9 | 6.0 | 70 | 2.3 | −75 | Inventive example |
| 29 | 1.72 | 1184 | 1285 | 92.1 | 6.6 | 58 | 2.4 | −60 | Inventive example |
| 30 | 1.79 | 1144 | 1295 | 88.3 | 7.8 | 55 | 2.8 | −60 | Inventive example |
| 31 | 1.35 | 1121 | 1210 | 92.6 | 9.6 | 70 | 1.9 | −80 | Inventive example |
| 32 | 1.05 | 1085 | 1228 | 88.4 | 9.0 | 70 | 1.4 | −65 | Inventive example |
| 33 | 1.95 | 1102 | 1281 | 86.0 | 9.6 | 58 | 2.8 | −45 | Inventive example |
| 34 | 2.23 | 1069 | 1208 | 88.5 | 6.5 | 75 | 2.9 | −45 | Inventive example |
| 35 | 1.60 | 1003 | 1124 | 89.2 | 8.1 | 88 | 2.1 | −80 | Comparative example |
| 36 | 1.21 | 1205 | 1309 | 92.1 | 9.9 | 27 | 1.9 | −40 | Comparative example |
| 37 | 1.46 | 1141 | 1200 | 95.1 | 7.6 | 45 | 2.2 | −50 | Comparative example |
| 38 | 2.59 | 1105 | 1313 | 84.2 | 10.1 | 56 | 3.8 | −40 | Comparative example |
| 39 | 1.49 | 1017 | 1164 | 87.4 | 7.0 | 79 | 2.0 | −70 | Comparative example |
| 40 | 1.93 | 1115 | 1319 | 84.5 | 12.1 | 53 | 2.8 | 15 | Comparative example |
| 41 | | A crack occurred during hot rolling | | | | | | | Comparative example |
| 42 | 1.35 | 1094 | 1202 | 91.0 | 8.3 | 50 | 1.9 | −20 | Comparative example |
| 43 | 2.23 | 1079 | 1234 | 87.4 | 9.7 | 58 | 3.1 | 20 | Comparative example |
| 44 | 1.45 | 1131 | 1256 | 90.0 | 8.7 | 63 | 2.1 | −10 | Comparative example |
| 45 | 1.24 | 1054 | 1158 | 91.0 | 9.6 | 78 | 1.9 | −60 | Comparative example |
| 46 | 1.45 | 1127 | 1282 | 87.9 | 7.3 | 38 | 2.4 | −20 | Comparative example |

From Table 3-1 and Table 3-2, it can be seen that, in each of Inventive examples, a high-strength hot rolled steel sheet that has a tensile strength TS of 1180 MPa or more and is excellent in stretch flange formability, bendability, and low-temperature toughness has been obtained. On the other hand, in Comparative examples outside the ranges according to aspects of the present invention, not all of the strength, stretch flange formability, bendability, and low-temperature toughness can satisfy the target capacities described above.

The invention claimed is:

1. A high-strength hot rolled steel sheet comprising :

a chemical composition containing, in mass %,

C: 0.07% or more and 0.20% or less,

Si: 0.10% or more and 2.0% or less,

Mn: 0.8% or more and 3.0% or less,

P: 0.100% or less (including 0%),

S: 0.0100% or less (including 0%),

Al: 0.010% or more and 2.00% or less,

N: 0.010% or less (including 0%),

Ti: 0.02% or more and less than 0.16%,

B: 0.0003% or more and 0.0100% or less, and the balance including Fe and incidental impurities; and a steel structure in which a lower bainite phase and/or a tempered martensite phase at 90% or more in terms of a total area fraction is contained as a dominant phase, an average grain size of the dominant phase is 10.0 μm or less, and an amount of Fe in Fe-based precipitates is 0.70% or less in mass %, wherein an arithmetic average roughness (Ra) of a surface is 2.50 μm or less, and a tensile strength TS is 1180 MPa or more.

2. The high-strength hot rolled steel sheet according to claim 1, wherein the chemical composition further contains at least one selected from the following groups A to D:

group A: one or two or more selected from, in mass %,

Cr: 0.01% or more and 2.0% or less,

Mo: 0.01% or more and 0.50% or less,

Cu: 0.01% or more and 0.50% or less, and Ni: 0.01% or more and 0.50% or less, group B: one or two selected from, in mass %, Nb: 0.001% or more and 0.060% or less, and V: 0.01% or more and 0.50% or less, group C: in mass %, Sb: 0.0005% or more and 0.0500% or less, and group D: one or two or more selected from, in mass %, Ca: 0.0005% or more and 0.0100% or less, Mg: 0.0005% or more and 0.0100% or less, and REMs: 0.0005% or more and 0.0100% or less.

3. The high-strength hot rolled steel sheet according to claim 1, comprising: a coating layer on a surface.

4. The high-strength hot rolled steel sheet according to claim 2, comprising: a coating layer on a surface.

5. A method for manufacturing a high-strength hot rolled steel sheet that is a method for manufacturing the high-strength hot rolled steel sheet according to claim 1, the method comprising:

heating a steel material to 1150° C. or more;

performing rough rolling on the steel material after the heating to form a steel sheet;

performing, before finish rolling to be performed after the rough rolling, high-pressure water descaling on the steel sheet under a condition of a collision pressure of 2.5 MPa or more;

performing finish rolling on the steel sheet after the high-pressure water descaling under a condition of a finisher delivery temperature of (RC −200° C.) or more and (RC +50° C.) or less, where an RC temperature is defined by Formula (1);

starting cooling after an end of the finish rolling, and performing cooling under conditions of a cooling stop temperature of 200° C. or more and an Ms temperature or less, where the Ms temperature is defined by Formula (2), and an average cooling rate of 20° C./s or more, and under a condition of a time from the end of the finish rolling to a start of the cooling being within 2.0 s in a case where the finisher delivery temperature is RC or more;

coiling the steel sheet after the cooling at the cooling stop temperature; and cooling the steel sheet under conditions of an average cooling rate of less than 20° C./s and a cooling stop temperature of 100° C. or less after the coiling to produce the high-strength hot rolled steel sheet, $$RC\ (^\circ\ \mathrm{C.})=850+100\times C+100\times N+10\times Mn+700\times Ti+5000\times B+10\times Cr+50\times Mo+2000\times Nb+150\times V \quad \text{Formula (1)}$$

$$Ms\ (^\circ\ \mathrm{C.})=560-470\times C-33\times Mn-24\times Cr-17\times Ni-20\times Mo \quad \text{Formula (2)}$$

where each of symbols of elements in Formula (1) and Formula (2) is a content amount (mass %) in steel of a respective element, and a symbol of an element in the formulae of a not-contained element is set to 0 for calculation.

6. A method for manufacturing a high-strength hot rolled steel sheet that is a method for manufacturing the high-strength hot rolled steel sheet according to claim 2, the method comprising:

heating a steel material to 1150° C. or more;

performing rough rolling on the steel material after the heating to form a steel sheet;

performing, before finish rolling to be performed after the rough rolling, high-pressure water descaling on the steel sheet under a condition of a collision pressure of 2.5 MPa or more;

performing finish rolling on the steel sheet after the high-pressure water descaling under a condition of a finisher delivery temperature of (RC −200° C.) or more and (RC +50° C.) or less, where an RC temperature is defined by Formula (1);

starting cooling after an end of the finish rolling, and performing cooling under conditions of a cooling stop temperature of 200° C. or more and an Ms temperature or less, where the Ms temperature is defined by Formula (2), and an average cooling rate of 20° C./s or more, and under a condition of a time from the end of the finish rolling to a start of the cooling being within 2.0 s in a case where the finisher delivery temperature is RC or more;

coiling the steel sheet after the cooling at the cooling stop temperature; and cooling the steel sheet under conditions of an average cooling rate of less than 20° C./s and a cooling stop temperature of 100° C. or less after the coiling to produce the high-strength hot rolled steel sheet, $$RC\ (^\circ\ \mathrm{C.})=850+100\times C+100\times N+10\times Mn+700\times Ti+5000\times B+10\times Cr+50\times Mo+2000\times Nb+150\times V \quad \text{Formula (1)}$$

$$Ms\ (^\circ\ \mathrm{C.})=560-470\times C-33\times Mn-24\times Cr-17\times Ni-20\times Mo \quad \text{Formula (2)}$$

where each of symbols of elements in Formula (1) and Formula (2) is a content amount (mass %) in steel of a respective element, and a symbol of an element in the formulae of a not-contained element is set to 0 for calculation.

7. The method for manufacturing the high-strength hot rolled steel sheet according to claim 5, further comprising: performing coating treatment on a surface of the steel sheet.

8. The method for manufacturing the high-strength hot rolled steel sheet according to claim 6, further comprising: performing coating treatment on a surface of the steel sheet.

9. The high-strength hot rolled steel sheet according to claim 1, wherein the arithmetic average roughness (Ra) of the surface is 2.50 μm or less and 1.05 μm or more.

* * * * *